US009914193B2

(12) United States Patent
Dovel

(10) Patent No.: US 9,914,193 B2
(45) Date of Patent: Mar. 13, 2018

(54) POWERED SHARPENER WITH COLD FORGING MEMBER

(71) Applicant: Darex, LLC, Ashland, OR (US)

(72) Inventor: Daniel T. Dovel, Shady Cove, OR (US)

(73) Assignee: Darex, LLC, Ashland, OR (US)

( * ) Notice: Subject to any disclaimer, the term of this patent is extended or adjusted under 35 U.S.C. 154(b) by 0 days.

(21) Appl. No.: 15/676,722

(22) Filed: Aug. 14, 2017

(65) Prior Publication Data

US 2017/0361413 A1 Dec. 21, 2017

Related U.S. Application Data

(63) Continuation-in-part of application No. 15/430,222, filed on Feb. 10, 2017, now Pat. No. 9,731,395.

(60) Provisional application No. 62/294,351, filed on Feb. 12, 2016.

(51) Int. Cl.
*B24B 3/54* (2006.01)
*B24B 23/06* (2006.01)

(52) U.S. Cl.
CPC ..... *B24B 3/54* (2013.01); *B24B 23/06* (2013.01)

(58) Field of Classification Search
CPC ..... B24B 3/54; B24B 23/06
USPC ..... 451/302, 55, 57–58; 76/82; 72/462, 703
See application file for complete search history.

(56) References Cited

U.S. PATENT DOCUMENTS 2,124,593 A * 7/1938 Schaefer ..... B24B 3/54 451/194
2,222,361 A * 11/1940 Burns ..... B24B 3/54 451/302
2,249,218 A 7/1941 Meade et al.
2,341,068 A * 2/1944 Zummach ..... B24B 3/54 451/302
2,359,997 A * 10/1944 Lamoreaux ..... B23B 27/24 72/108
3,119,289 A * 1/1964 Bach ..... B21B 15/0085 228/19
4,043,082 A 8/1977 Ferroglio
4,533,409 A * 8/1985 Benford ..... C21D 8/1294 148/111
4,964,241 A 10/1990 Conklin
5,957,758 A * 9/1999 Shrum ..... B24B 23/06 451/59
6,648,737 B2 * 11/2003 Deware ..... B24B 23/06 451/297

(Continued)

*Primary Examiner* — George Nguyen
(74) *Attorney, Agent, or Firm* — Hall Estill Attorneys at Law

(57) ABSTRACT

Method and apparatus for sharpening a cutting tool having a blade portion with a cutting edge, such as but not limited to a kitchen knife. In some embodiments, a powered sharpener has an abrasive medium that is advanced by a motor and an edge guide surface adjacent the abrasive medium, wherein the cutting edge of the cutting tool is sharpened by bringing a first portion of the cutting edge into contacting engagement with the edge guide surface and drawing a second portion of the cutting edge across the abrasive medium. A plurality of spaced apart channels are formed in the sharpened cutting edge by contactingly engaging the sharpened cutting edge with a cold forging member with sufficient force to displace portions of the sharpened cutting edge. The channels in the sharpened cutting edge constitute locally deformed, work hardened notches.

24 Claims, 20 Drawing Sheets

(56) References Cited

U.S. PATENT DOCUMENTS

| | | | | |
|---|---|---|---|---|
| 8,696,407 | B2 * | 4/2014 | Dovel | B24B 3/52 451/296 |
| 8,784,162 | B1 * | 7/2014 | Dovel | B24B 3/54 451/303 |
| 8,943,698 | B2 * | 2/2015 | Hirai | B24D 15/084 30/138 |
| 8,944,894 | B2 | 2/2015 | Smith et al. | |
| 8,998,680 | B1 | 4/2015 | Dovel | |
| 2004/0154373 | A1 * | 8/2004 | Mayr | B23B 27/24 72/104 |
| 2004/0198198 | A1 | 10/2004 | Friel et al. | |
| 2007/0243799 | A1 | 10/2007 | Fuchs | |
| 2008/0261494 | A1 | 10/2008 | Friel et al. | |
| 2008/0300612 | A1 * | 12/2008 | Riza | A61B 17/3215 606/167 |
| 2011/0201257 | A1 | 8/2011 | Walker | |
| 2014/0057537 | A1 * | 2/2014 | Menegon | B24B 3/54 451/302 |
| 2014/0199926 | A1 | 7/2014 | Dovel | |
| 2015/0343591 | A1 * | 12/2015 | Dovel | B24B 3/36 451/349 |
| 2016/0303747 | A1 * | 10/2016 | Dovel | B21K 11/02 |

* cited by examiner

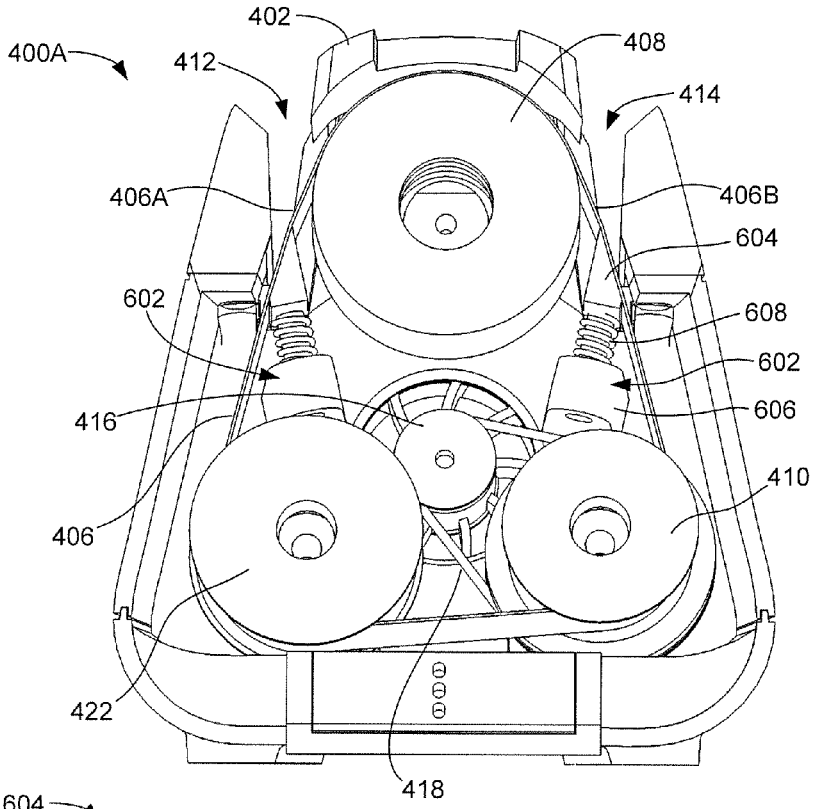
FIG. 21
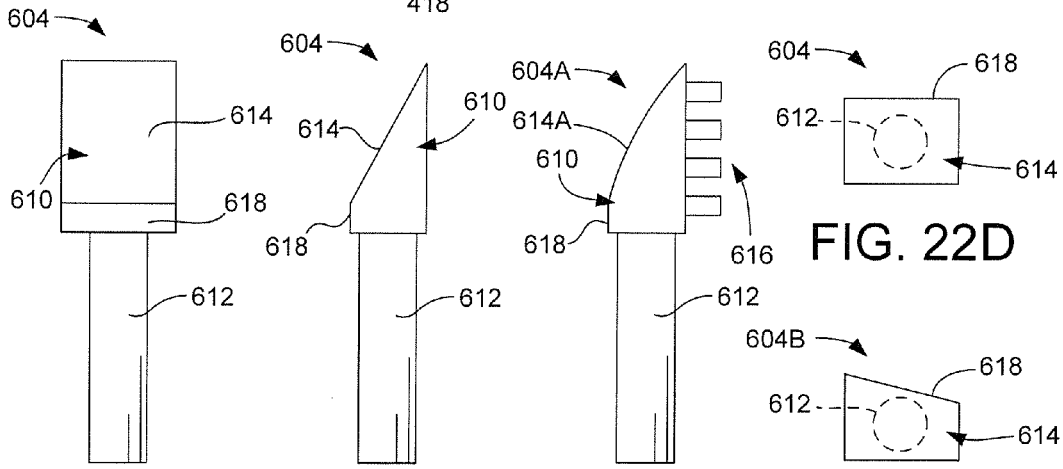
FIG. 22D
FIG. 22A FIG. 22B FIG. 22C FIG. 22E

POWERED SHARPENER WITH COLD FORGING MEMBER

RELATED APPLICATION

The present application is a continuation-in-part of copending U.S. patent application Ser. No. 15/430,222 filed Feb. 10, 2017, issued as U.S. Pat. No. 9,731,395 on Aug. 15, 2017 and which claimed domestic priority to U.S. Provisional Patent Application No. 62/294,351 filed Feb. 12, 2016, the contents of which are hereby incorporated by reference.

BACKGROUND

Cutting tools are used in a variety of applications to cut or otherwise remove material from a workpiece. A variety of cutting tools are well known in the art, including but not limited to knives, scissors, shears, blades, chisels, machetes, saws, drill bits, etc.

A cutting tool often has one or more laterally extending, straight or curvilinear cutting edges along which pressure is applied to make a cut. The cutting edge is often defined along the intersection of opposing surfaces (bevels) that intersect along a line that lies along the cutting edge.

In some cutting tools, such as many types of conventional kitchen knives, the opposing surfaces are generally symmetric; other cutting tools, such as many types of scissors and chisels, have a first opposing surface that extends in a substantially normal direction, and a second opposing surface that is skewed with respect to the first surface.

Complex blade geometries can be used, such as multiple sets of bevels at different respective angles that taper to the cutting edge. Scallops or other discontinuous features can also be provided along the cutting edge, such as in the case of serrated knives.

Cutting tools can become dull over time after extended use, and thus it can be desirable to subject a dulled cutting tool to a sharpening operation to restore the cutting edge to a greater level of sharpness. A variety of sharpening techniques are known in the art, including the use of grinding wheels, whet stones, abrasive cloths, abrasive belts, etc.

SUMMARY

Various embodiments of the present disclosure are generally directed to a sharpener for sharpening a cutting tool having a blade portion with a cutting edge, such as but not limited to a kitchen knife.

In some embodiments, a powered sharpener has an abrasive medium that is advanced by a motor and an edge guide surface adjacent the abrasive medium, wherein the cutting edge of the cutting tool is sharpened by bringing a first portion of the cutting edge into contacting engagement with the edge guide surface and drawing a second portion of the cutting edge across the abrasive medium. A plurality of spaced apart channels are formed in the sharpened cutting edge by contactingly engaging the sharpened cutting edge with a cold forging member with sufficient force to displace portions of the sharpened cutting edge. The channels in the sharpened cutting edge constitute locally deformed, work hardened notches.

These and other features and advantages of various embodiments can be understood with a review of the following detailed description in conjunction with the accompanying drawings.

BRIEF DESCRIPTION OF DRAWINGS

FIG. 21 illustrates another tilted angle abrasive sharpener similar to the sharpener of FIG. 14 with a platen assembly in accordance with further embodiments.

FIGS. 22A through 22E show aspects of the platen assembly in accordance with various embodiments.

DETAILED DESCRIPTION

Figure 1:
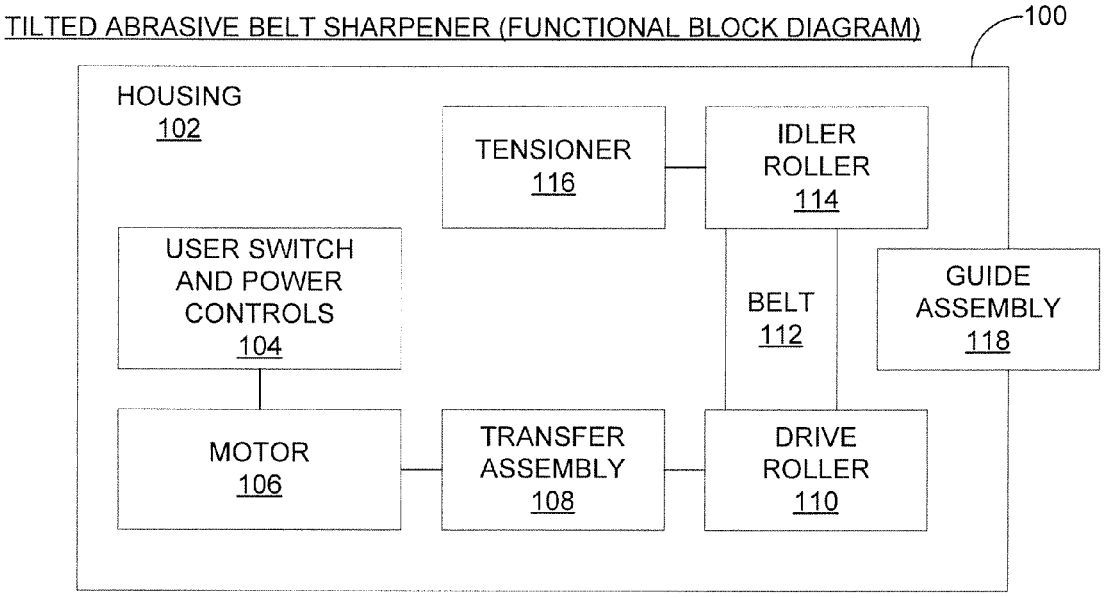
FIG. 1 provides a functional block diagram for a tilted angle abrasive belt sharpener constructed and operated in accordance with various embodiments of the present disclosure.

Generally, so-called slack belt sharpening techniques can be used to sharpen the cutting edge of a cutting tool, such as a knife, using a power-driven endless abrasive belt. One non-limiting example of a slack belt powered sharpener is provided in U.S. Pat. No. 8,696,407, assigned to the assignee of the present application.

As discussed more fully in the '407 patent, slack belt sharpening generally involves using an unsupported expanse of abrasive belt to contactingly engage a cutting edge of a knife or other cutting tool at an appropriate presentation (bevel) angle to deform a portion of the belt out of a neutral plane (e.g., a planar extent of the belt extending between a pair of belt supports, such as rollers). The deflection of the belt generally induces a small twisting effect in relation to curvilinear changes in the cutting edge along the length of the knife.

In this way, a user can draw the cutting edge across the moving belt and the belt will automatically adjust to follow the contour of the cutting edge as it removes material along the blade portion of the knife. By applying respective sharpening operations to opposing sides of the blade, a sharpened cutting edge can be efficiently produced.

While operable, one limitation that has been found with these and other forms of slack-belt sharpeners is a non-uniform amount of material removal along the length of the blade (e.g., so called material take off, or MTO rate). Certain types of cutting tools, such as kitchen ("chef") knives, tend to have a curvilinearly extending cutting edge with relatively small amounts of curvature near a handle of the knife and increasingly greater amounts of curvilinearity near the tip of the blade. In such knives, it has been found that the unsupported segment of the belt can tend to remove too little material at the base of the blade near the handle, and too much material near the tip. One factor that induces this variation is the amount of deflection (twist) induced in the belt; generally, the greater the deflection, the higher the localized surface pressure and higher the corresponding MTO rate.

It follows that some belt sharpening operations can result in a rounding of the tip of the blade rather than retaining the tip as a sharp, well defined point, as well as incomplete sharpening of the cutting edge immediately adjacent the handle. While the user may be able to mitigate these and other effects through controlled presentation and withdrawal of the blade across the belt, various embodiments of the present disclosure present a number of operative features that can promote easier, more consistent abrasive belt sharpening that reduces such variations in surface pressure and corresponding MTO rates during a sharpening operation.

As explained below, such features include the use of what is collectively and/or variously referred to herein as "tilted angle abrasive belt sharpening." Generally, tilted angle abrasive belt sharpening, also referred to as "modified slack belt sharpening," refers to a novel sharpener configuration and methodology that purposefully induces a selected non-orthogonal alignment between the cutting edge of the knife or other cutting tool with respect to the abrasive belt in order to better control surface pressures and corresponding MTO rates across the width of the belt. A variety of different approaches can be used to achieve this tilted sharpening effect.

In some embodiments, a presentation angle of the knife or other cutting tool is fixed at a selected non-orthogonal angle with respect to the axis of one or more rollers along which the endless abrasive belt is driven. This may be carried out by tilting the belt path in a "backward" direction so that the top of the belt path is moved in a direction away from the user and using a substantially horizontal set of edge guides to support the presentation of the tool. Another way in which the non-orthogonal angle can be established is by skewing the presentation angle of the knife inwardly with respect to the belt. Yet another way the non-orthogonal angle can be established is through the use of a backing support member the supports the belt in the vicinity of the contact zone. These respective approaches can be combined or used individually.

In each of these cases, surface pressures and corresponding MTO rates are controlled to enhance the sharpening process. Depending on the configuration, greater surface pressures and higher MTO rates can be supplied to the front edge of the belt (e.g., closer to the user or adjacent a proximal end of the tool) and lower surface pressures and lower MTO rates can be supplied to the rear edge of the belt (e.g., farther from the user or adjacent a distal end of the tool).

These and other features and advantages of various embodiments of the present disclosure can be understood beginning with a review of FIG. 1 which shows a functional block diagram of a tilted angle abrasive belt sharpener 100. An initial overview of various operative elements of the sharpener 100 will enhance an understanding of various sharpening geometries established by the sharpener which will be discussed below. It will be appreciated that sharpeners constructed and operated in accordance with various embodiments can take various forms so that the particular elements represented in FIG. 1 are merely for illustrative purposes and are not limiting.

The exemplary sharpener 100 is configured as a powered sharpener designed to rest on an underlying horizontal base surface, such as a table top, and to be powered by a source of electrical power such as residential or commercial alternating current (AC) voltage, a direct current (DC) battery pack, etc. Other forms of tilted angle abrasive belt sharpeners can be implemented, including hand-held sharpeners, non-powered sharpeners, etc. that employ the various features disclosed herein.

The sharpener 100 includes a rigid housing 102 that may be formed of a suitable rigid material such as but not limited to injection molded plastic. A user switch and power control module 104 includes one or more user operable switches (e.g., power, speed control, etc.) and power conversion circuitry to transfer electrical power to an electrical motor 106.

The motor 106 induces rotation of a shaft or other coupling member linked to a power transfer assembly (PTA) 108, which may include various mechanical elements such as gears, linkages, etc. which, in turn, impart rotation to one or more drive rollers 110. It is contemplated albeit not necessarily required that the drive roller 110 will rotate at a steady state rotational velocity during powered operation of the sharpener.

An endless abrasive belt 112 extends about the drive roller 110 and at least one additional idler roller 114. In some cases, multiple rollers may be employed by the sharpener, such as three or more rollers to define a segmented belt path. A tensioner 116 may impart a bias force to the idler roller 114 to supply a selected amount of tension to the belt. A guide assembly 118 is configured to enable a user to present a cutting tool such as a knife against a segment of the belt 112 between the respective rollers 110, 114 along a desired presentation orientation, as discussed below.

Figure 2A:
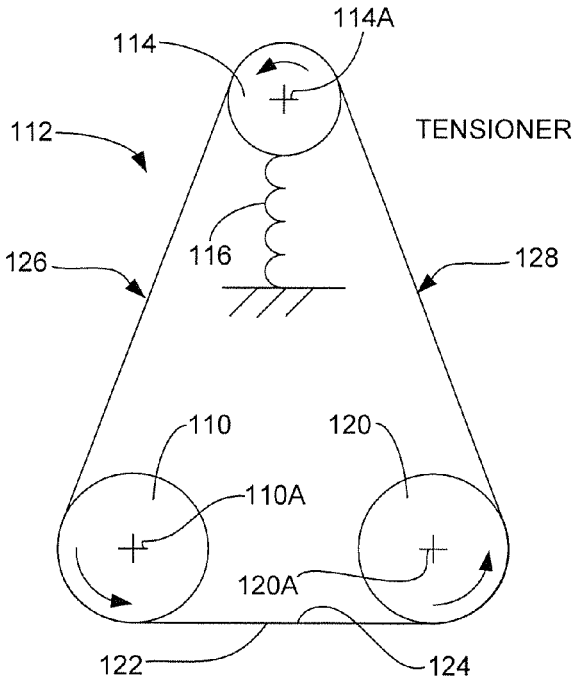
FIG. 2A is a schematic depiction of aspects of the sharpener of FIG. 1.

A schematic representation of the belt path is provided in FIG. 2A in accordance with some embodiments. A generally triangular path is established for the belt 112 through the use of three rollers: the drive roller 110 in the lower left corner, the idler roller 114 at the top of the belt path, and a third roller 120 which may also be an idler roller. It will be appreciated that any number of belt paths can be established using any suitable corresponding numbers and sizes of rollers as desired so that a triangular path is used in some embodiments, but not others. The tensioner 116 (FIG. 1) is represented as a coiled spring operable upon the idler roller 114 in a direction away from the remaining rollers 110, 120. Other tensioner arrangements can be used including, but not limited to, a tensioner that applies the tension force to lower idler roller 120.

Figure 2B:
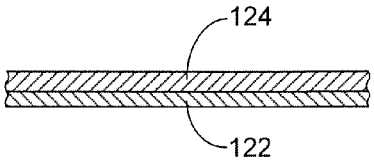
FIG. 2B shows a generalized, cross-sectional representation of the belt from FIG. 2A in greater detail.

The belt 112 has an outer abrasive surface denoted generally at 122 and an inner backing layer denoted generally at 124 that supports the abrasive surface. These layers are shown more fully in FIG. 2B. The relative thicknesses of these respective layers can vary. The abrasive surface 122 includes a suitable abrasive material operative to remove material from the knife during a sharpening operation. The backing layer 124 provides mechanical support and other characteristic features for the belt such as belt stiffness, overall thickness, belt width, etc. The backing layer 124 is configured to contactingly engage the respective rollers 110, 114 and 120 during powered rotation of the belt along the belt path.

The exemplary arrangement of FIG. 2A establishes two respective, elongated planar segments 126, 128 of the belt 112 against which the knife or other cutting tool can be presented for sharpening operations on alternate sides thereof. Segment 126 substantially extends from roller 114 to roller 110, and segment 128 substantially extends from roller 120 to roller 114. Each of the segments 126, 128 normally lies along a neutral plane that is orthogonal to respective rotational axes 110A, 114A and 120A of the rollers 110, 114 and 120.

Each segment 126, 128 is unsupported by a corresponding restrictive backing support member against the backing layer 124. This allows the respective segments to remain aligned along the respective neutral planes in an unloaded state and to be rotationally deflected ("twisted") out of the neutral plane during a sharpening operation through contact with the knife. It is contemplated that one or more support members can be applied to the backing layer 128 in the vicinity of the segments 126, 128, such as in the form of a leaf spring, etc., so long as the support member(s) still enable the respective segments to be rotationally deflected away from the neutral plane during the modified slack-belt sharpening operation. A specially configured support member that provides controlled support to less than the full width of the belt will be discussed below.

Figure 3:
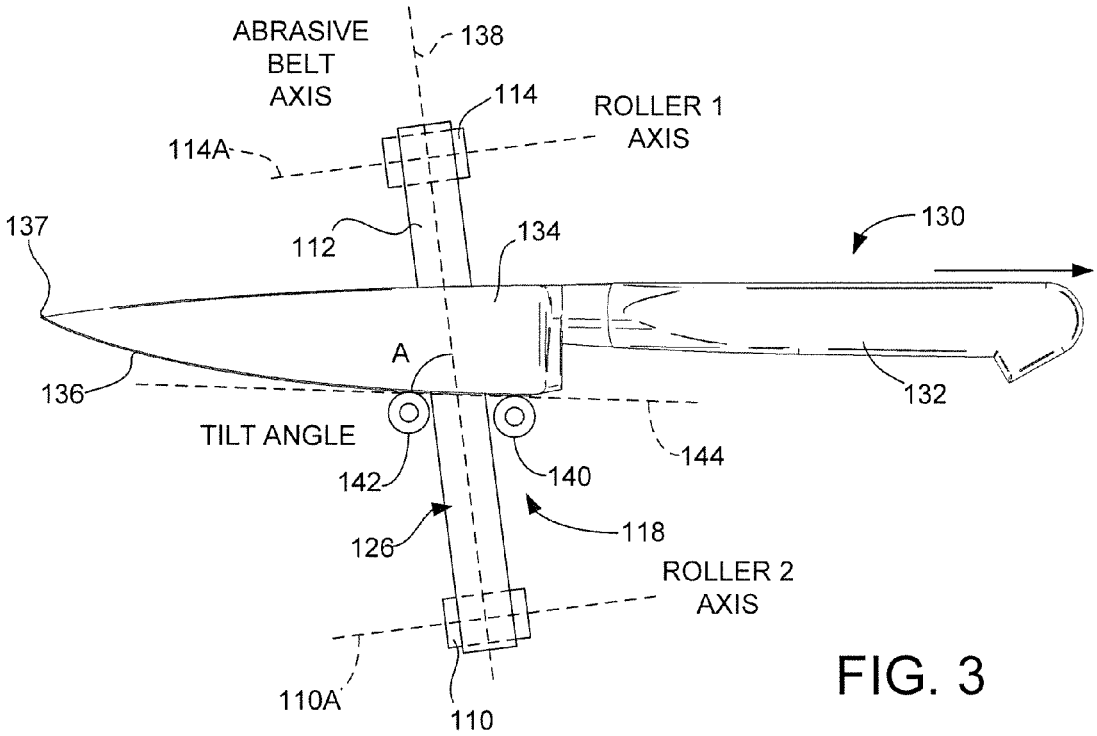
FIG. 3 illustrates a tilt angle mechanism of the sharpener of FIG. 1 that imparts a tilted angle sharpening operation upon a kitchen knife in accordance with some embodiments.

FIG. 3 shows aspects of the exemplary sharpener 100 in accordance with some embodiments. A cutting tool 130, in the form of a kitchen (or chef) knife, is presented against the segment 126 of the belt 112 between rollers 110, 114. The knife 130 includes a user handle 132 and a blade 134 with a curvilinearly extending cutting edge 136. The cutting edge 136 extends to a distal tip 137 and is formed along the intersection of opposing sides (not numerically denoted) of the blade 134 which taper to a line. Removal, honing and/or alignment of material from the respective sides of the blade 134 operate to produce a sharpened cutting edge 136 along the entire length of the blade.

An abrasive belt axis is represented by broken line 138 and indicates a direction of travel and alignment of the belt 112 during operation. The abrasive belt axis 138 is nominally orthogonal to the respective roller axes 110A, 114A of rollers 110, 114 (identified in the drawing as Roller Axes 1 and 2).

A pair of edge guide rollers are represented at 140, 142. The edge guide rollers form a portion of the aforementioned guide assembly 118 (see FIG. 1), and can be made of any suitable material designed to support portions of the cutting edge 136. Other forms of edge guides can be used, including stationary edge guides as discussed below.

Generally, the edge guide rollers 140, 142 provide edge guide surfaces that serve as plunge depth limiting surfaces to limit the distance the knife 130 can be lowered, or advanced, toward the belt 112. The surfaces define a retraction path 144 for the blade 134 as the user draws the cutting edge across the belt 112 via the handle 132 while drawing the cutting edge 136 in contacting engagement across the rollers.

The retraction path 144 is non-orthogonal to the abrasive belt axis 138. The intervening angle between lines 138 and 144 is referred to herein as a tilt angle, and is denoted in FIG. 3 as angle A. For reference, the term "retraction" and the like as used herein will be understood as describing relative movement of the blade or other cutting tool relative to an associated abrasive surface in any suitable direction including away from or toward the user.

Figure 4:
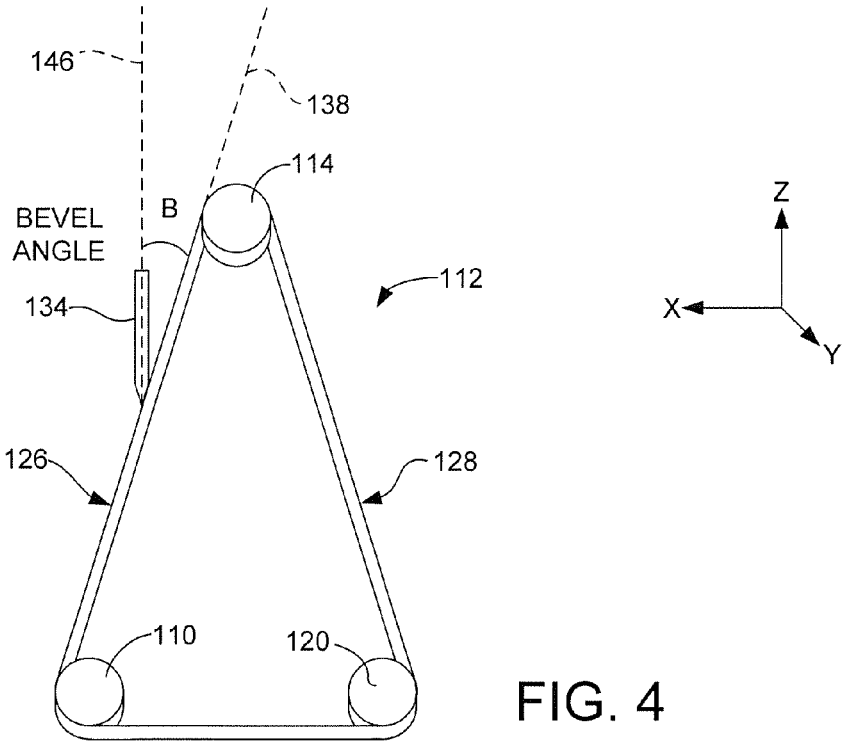
FIG. 4 illustrates a bevel angle imparted to the kitchen knife by the tilt angle mechanism of FIG. 3 in accordance with some embodiments.

A second angle, referred to herein as a bevel angle, is represented as angle B in FIG. 4. Generally, the bevel angle B represents the intervening angle between the abrasive belt axis 138 and a lateral centerline of the blade 134, denoted at 146. The tilt angle can be thought of as the relative angle of the cutting edge 136 "across" the belt (see FIG. 3) and the bevel angle can be thought of as the relative angle of the blade 136 "along" the belt (see FIG. 4).

The magnitude of the tilt angle A can vary. In some embodiments, the tilt angle A as defined in FIG. 3 is selected to be less than 90 degrees, such as but not limited to the range of from about 65 degrees to about 89 degrees. This is in contrast to other belt sharpeners, such as but not limited to the sharpener disclosed in the '407 patent mentioned above, which provides a presentation angle of nominally 90 degrees. At this point it will be noted that other formulations for the tilt angle can be used as desired. For example, a review of FIG. 3 shows that the tilt angle can alternatively be defined as the non-orthogonal angle between the presentation line 144 and the respective roller axes 110A, 114A (e.g., the complementary angle to angle A). Using this alternative formulation, the tilt angle may be on the order of from about 1 degree to about 25 degrees.

The magnitude of the bevel angle B can also vary. In some embodiments, the bevel angle B is selected to be in the range of from about 5 to about 15 degrees. The bevel angle generally determines the side geometry of the blade adjacent the cutting edge. For clarity, it will be appreciated that the conformal nature of the belt 112 will tend to impart a convex curvilinear shape to the side of the cutting edge rather than a flat "bevel" shape. Nevertheless, the term "bevel" is useful in generally denoting the relative orientation between the belt extent 126 and the blade 134.

The non-orthogonal tilt angle A is selected to reduce the deflection of the rear edge of the belt (e.g., that portion of the belt farthest from the handle) and to increase the deflection of the front edge of the belt (e.g., that portion of the belt closest to the handle). Tilting the belt with respect to the blade such as exemplified in FIG. 3 provides a more uniform average surface pressure across the length of the cutting edge 136 from the handle 132 to the tip 137.

Referring again to FIG. 3, it will be noted that the edge guide rollers 140, 142 define the presentation line 144 so as to be nominally horizontal (e.g., along the X-Y plane), and the belt is tilted forward so that the respective roller axes 110A, 114A are skewed with respect to the horizontal direction. This allows the user to present the knife 130 in a substantially horizontal fashion as the knife is drawn across the belt. This arrangement is merely illustrative and is not limiting. In other embodiments, these respective elements may be rotated such that the belt 112 is vertical (e.g., roller axes 110A and 114A are horizontally disposed and the belt extends along the X-Z plane), and the edge guide rollers 140, 142 are adjusted so that the presentation line 144 extends upwardly in a non-horizontal fashion. In this latter case, the user may draw the knife across the belt such that the handle 132 is relatively lower and the tip 137 is relatively higher above a horizontal base surface on which the sharpener rests. Other arrangements may be used as well.

Figure 5:
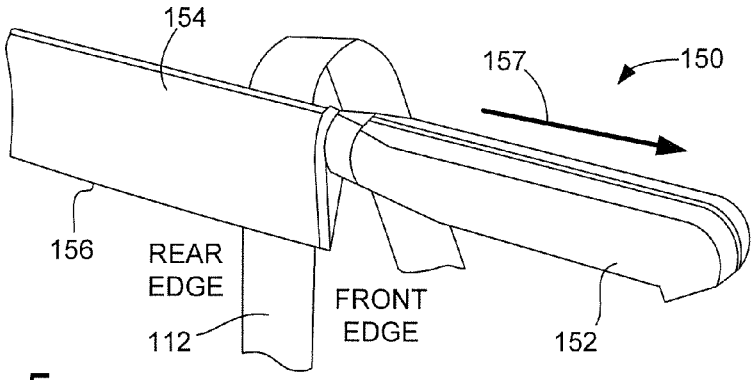
FIG. 5 is an isometric depiction of the relative arrangement of the kitchen knife and the belt of FIGS. 3-4.

FIG. 5 is an isometric depiction of another knife 150 adjacent the belt 112. The knife 150 is similar to the knife 130 discussed above and includes a handle 152, blade 154 and cutting edge 156. During sharpening, the cutting edge 156 is drawn across the belt 112 in direction 157. Respective front and rear edges of the belt are denoted with respect to this direction. It will be recalled that the front edge of belt is that portion of the width of the belt closest to the handle 152, and the rear edge is that portion of the width of the belt farthest away from the handle.

Figure 6A:
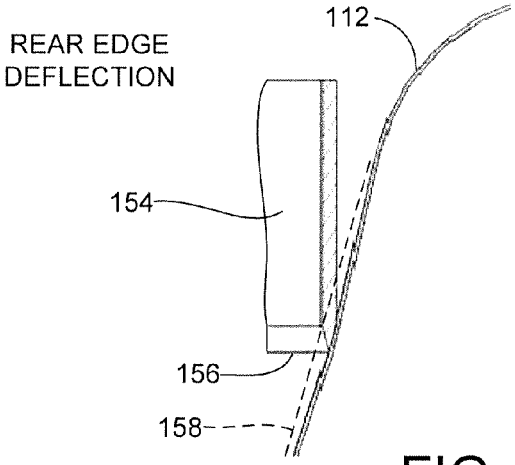
FIGS. 6A and 6B illustrate different relative amounts of belt deflection adjacent rear and front edges of the belt, respectively, induced by the tilt belt mechanism shown in FIG. 3.
Figure 6B:
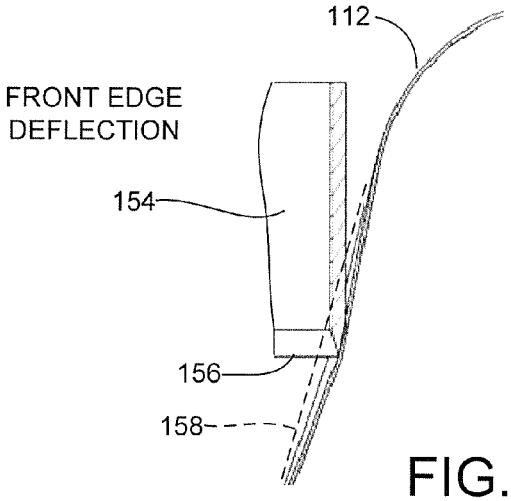

FIG. 6A is a cross-sectional representational view of the rear edge deflection encountered by the belt. FIG. 6B shows a corresponding cross-sectional representational view of the front edge deflection encountered by the belt. Dotted line 158 represents the neutral plane along which the belt 112 normally lies in the absence of the knife 150 or other cutting tool.

From FIGS. 6A and 6B it can be seen that a larger amount of deflection (twist) is incurred at the front edge of the belt as compared to the rear edge. The tilt angle and the width of the belt will influence the difference between the front and rear deflection. This difference can be optimized for a specific belt/abrasive combination as well as for the shape of the blade being sharpened. Generally, decreasing the tilt angle A (see FIG. 3) and/or increasing the belt width will tend to increase the difference between the front and rear deflection amounts. This in turn will adjust the relative surface pressure and MTO rates at the front and rear edges.

The particular configuration of the sharpener 100 (see FIG. 1) can be arranged to achieve the desired tilt and bevel angles. As noted above, the belt and rollers can be "canted" within the interior of the housing 102 so that a user presents the knife (or other cutting tool) via the guide assembly 118 in a substantially horizontal orientation, as generally depicted in FIGS. 3-4. In other embodiments, the belt and rollers can be nominally vertically aligned within the housing 102 and the user can present the knife against the guide assembly 118 at an elevated, non-horizontal orientation. These and other considerations are well within the ability of the skilled artisan to implement depending on the requirements of a given application.

Figure 7A:
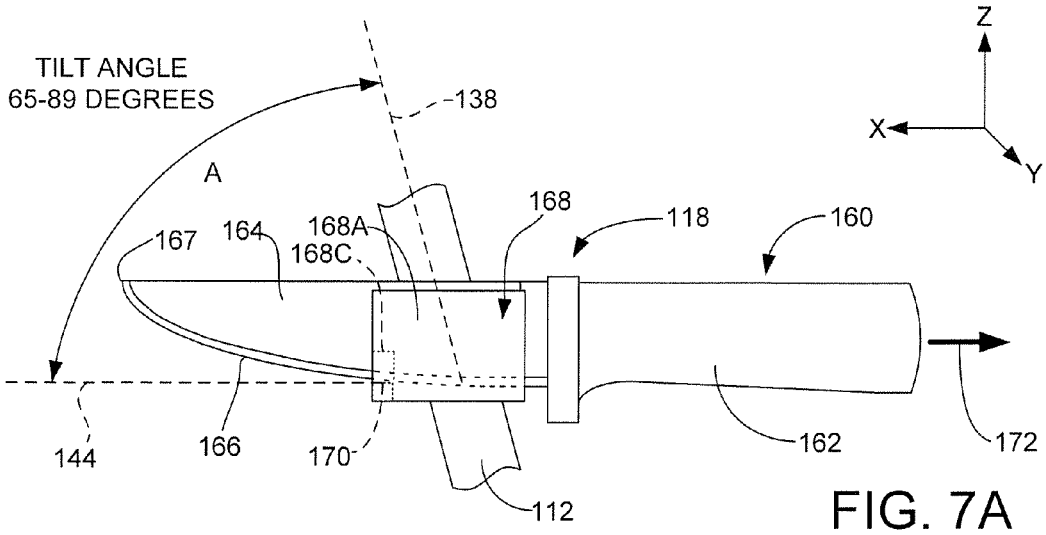
FIGS. 7A through 7E show aspects of an alternative tilt belt mechanism in accordance with further embodiments.
Figure 7B:
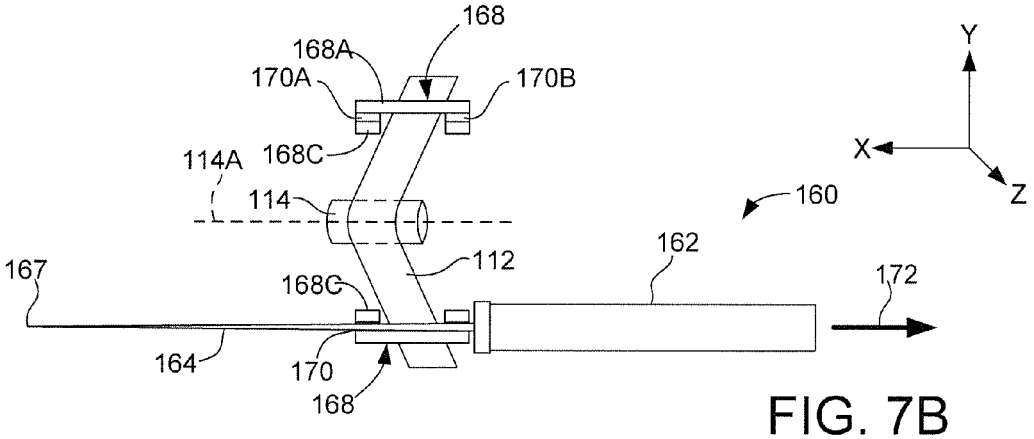

FIGS. 7A through 7E illustrate aspects of the sharpener 100 of FIG. 1 in accordance with further embodiments. A knife 160 includes a handle 162, blade 164 and cutting edge 166 which tapers to a point 167. The aforementioned guide assembly 118 includes a guide member 168 which provides a guide surface in facing relation to the belt 112 to facilitate alignment of the blade 164 thereagainst. A stationary edge support surface 170 allows the user to support a portion of the cutting edge 166 as the user withdraws the blade across the belt 112 in direction 172. It will be noted that a single edge guide surface 170 can be used as illustrated in FIG. 7A, or multiple edge guide surfaces 170A, 170B can be utilized as illustrated in FIG. 7B.

The relative tilt angle A between the guide 168 and the belt 112 is contemplated as extending from about 65 degrees to about 89 degrees, as indicated in FIG. 7A. Other angles can be used so long as the tilt angle is nominally non-orthogonal to an axis associated with the belt path (e.g., belt axis, roller axis).

As noted above, an alternative way to define the non-orthogonal tilt angle A is to state that the retraction path line 144 is non-parallel with the associated roller axes that support the segment of belt against which the knife is drawn (see e.g., roller axes 110A, 114A in FIG. 3). Using this latter formulation, the tilt angle range of 65-89 degrees between lines 138, 144 would correspond to the complementary angle range of from about 1 to about 25 degrees between line 144 and the roller axes 110A, 114A (see e.g., FIG. 3).

Figure 7C:
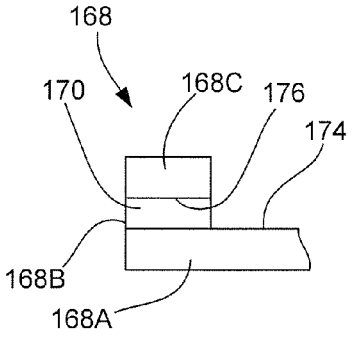
Figure 7D:
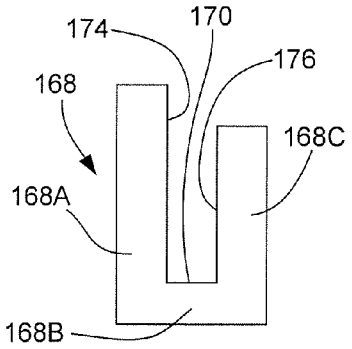

FIG. 7B shows the use of two guides 168 on opposing sides of the topmost roller 114 to enable double sided sharpening operations. FIG. 7C shows a top plan view of a portion of one of the guides 168, and FIG. 7D shows a corresponding elevational view of the guide from FIG. 7C. The guide 168 includes a substantially vertically extending outward portion 168A, a substantially horizontally extending base portion 168B and a substantially vertically extending inward portion 168C.

The aforementioned edge surface 170 extends along the top of portion 168B. An inwardly facing guide surface 174 extends along portion 168A, and an outwardly facing guide surface 176 extends along portion 168C. Surfaces 170, 174 and 176 form a generally u-shaped channel, or guide slot, to accommodate the knife 160. The edge guide surface contactingly supports the cutting edge 166, and the opposing side guide surfaces can contactingly support the opposing sides of the blade 164. The relative elevation and orientation of the surfaces 170, 174 and 176 are selected with respect to the central axis 138 of the belt 112 (see FIG. 7A) to provide the desired tilt angle. It will be noted that the guide surfaces 174, 176 lie along associated planes each parallel to each of the roller axes 110A, 114A and 120A.

Figure 7E:
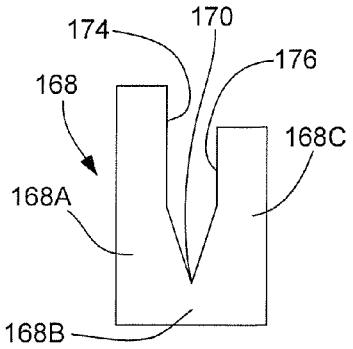

FIG. 7E shows an alternative construction for the guide 168. The respective interior guide surfaces 170, 174 and 176 taper to provide narrowed, substantially v-shaped guide slot. The guide elements 168A-168C may be formed of a suitable non-abrasive cuttable or non-cuttable material to support the cutting tool.

Figure 8A:
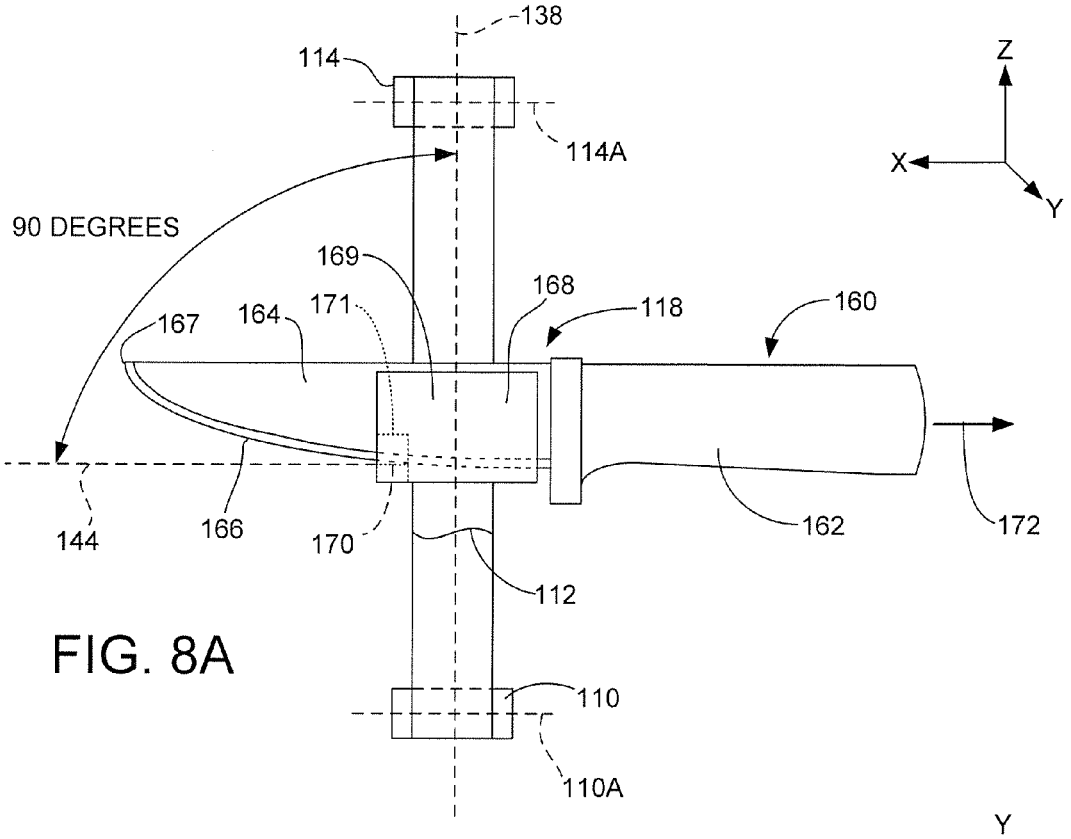
FIGS. 8A and 8B show the knife of FIG. 7 during a sharpening operation with yet another tilt belt mechanism as compared to FIGS. 7A through 7E.
Figure 8B:
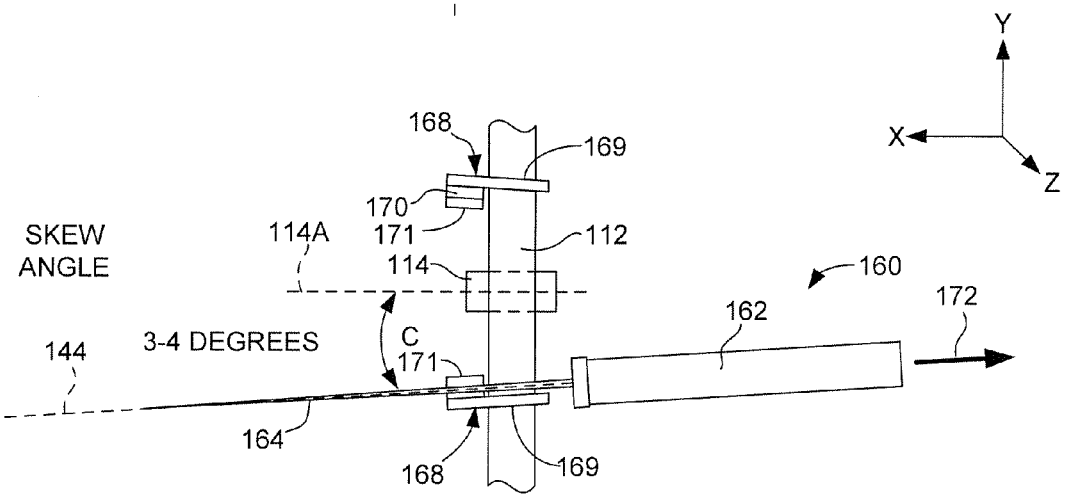

FIGS. 8A and 8B show another embodiment for the sharpener 100 of FIG. 1. Similar elements are identified by like reference numerals from FIGS. 7A-7E. FIG. 8A shows the knife 160 to be aligned in the guide member 168 with the stationary edge guide surface 170 from FIGS. 7C and 7D. In this case, the retraction path line 144 is nominally orthogonal to the belt axis 138 (e.g., nominally 90 degrees), as shown by FIG. 8A.

However, as further shown by the top plan view of FIG. 8B, the guide 168 and edge support surface 170 are skewed with respect to the central axis 114A of the top roller 114 (see FIG. 3) by a skew angle C. Unlike in FIGS. 7A-7E where the tilt angle A is generally along the X-Z plane, the skew angle C in FIGS. 8A-8B is along the X-Y plane. The skew angle C between the axis 114A and the line 144 is on the order of about 3 to about 4 degrees. Other ranges of angles can be used as required. Further amounts of non-orthogonality can be supplied by combining the arrangement of FIGS. 7A-7B with that of FIGS. 8A-8B; for example, the guide member 168 can be aligned so as to be nonparallel with the axis 114A as in FIG. 8B as well as non-orthogonal to the belt axis 138 as in FIG. 7A. Stated another way, both some measure of tilt angle A and skew angle C can be concurrently imparted by the guide member 168. As before, the guide 168 can use a single edge guide surface 170 (see, e.g., FIG. 8B) or a pair of edge guide surfaces (see e.g., guide surfaces 170A and 170B in FIG. 7B).

While the tilt belt arrangement of FIGS. 8A and 8B can provide similar benefits as an arrangement such as shown in FIGS. 7A and 7B, it will be noted by those skilled in the art that arrangements such as depicted in FIGS. 7A-7B may enable better sharpening at the base of the blade adjacent the handle since larger features (e.g., thumb guards, etc.) proximate the juncture between handle and blade can be more readily accommodated. It is noted that the skewed guides in FIGS. 8A and 8B can take the general configurations shown in FIGS. 7C through 7E except that the respective guides are skewed. For example, the respective guide surfaces 174, 176 would lie along respective planes that intersect (e.g., are non-parallel with) the roller axes 110A, 114A and 120A.

Figure 9A:
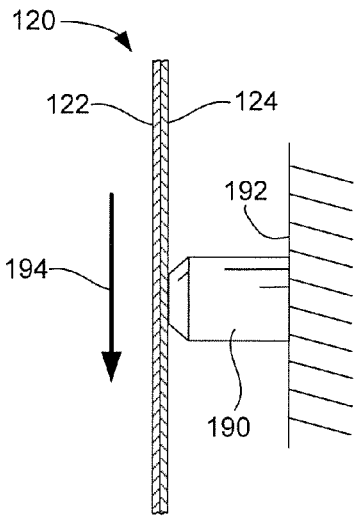
FIGS. 9A and 9B illustrate another tilt belt mechanism that can be used in some embodiments.
Figure 9B:
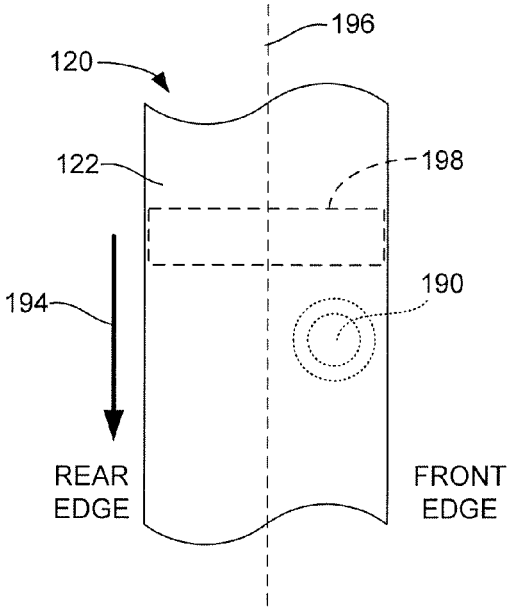

FIGS. 9A and 9B show another configuration of the tilted belt abrasive sharpener 100 of FIG. 1 in accordance with further embodiments. A localized support member 190 is supported by a stationary, rigid base (shown schematically at 192) behind the belt 112. The support member 190 is arranged to contactingly engage and support the backing layer 124 as the belt 112 moves in direction of travel 194. The support member 190 is represented as a cylindrically shaped, tapered pin for clarity of illustration, although any number of different configurations can be used as required.

A suitable low wear material may be used for stationary support members such as 190. Any number of contact shapes can be used (e.g., circular, oval, rectangular, etc). It is contemplated that the support member 190 and base 192 may be incorporated as a portion of the guide assembly used to support the cutting tool (see e.g., guide 168 in FIGS. 7A through 8B).

As further illustrated in FIG. 9B, the support member 190 is offset with respect to a centerline 196 of the belt 112 so as to provide contacting support to the backing layer 124 on only a single side of the centerline, e.g., on the side closest to the handle of the tool (e.g., the front edge of the belt; see FIG. 5). A contact region 198 generally represents that portion of the belt 112 that will nominally contact the side of the tool during the sharpening operation. The location of tool contact is offset (e.g., above) the pin 190. The side of the belt farthest from the handle of the tool (e.g., the rear edge of the belt) remains unsupported.

As the belt serpentines over the pin and adjacent the tool, a greater surface pressure and a higher MTO rate are applied closer to the handle (front edge of the belt or to the right of centerline 196 in FIG. 9B), and a lower surface pressure and a lower MTO rate are applied farther from the handle (rear edge of the belt or to the left of centerline 196 in FIG. 9B).

The relative presentation angle of the tool (see e.g., line 144 in FIG. 3) can be any suitable angle, including orthogonal or non-orthogonal to the belt centerline 196. The support member 190 can thus be used in a stand-alone fashion, or can be added to any of the previous embodiments utilized above.

FIGS. 10A through 10D show yet another embodiment for the tilt angle abrasive belt sharpener 100 of FIG. 1 that is similar to the embodiment of FIGS. 9A and 9B, except that the embodiment of FIGS. 10A-10D uses a rotatable support member 200 ("support roller") that is arranged to rotate about a rotatable roller axis 200A to provide variable surface pressure and MTO rates across the width of the belt 112.

Figure 10A:
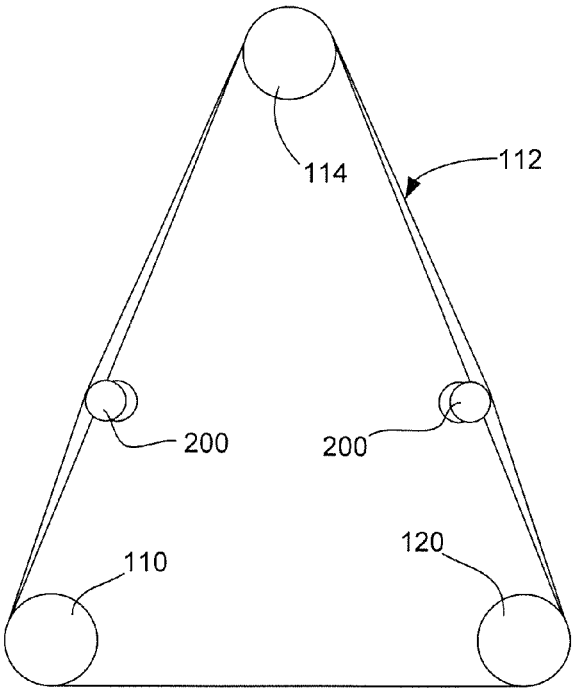
FIGS. 10A through 10D show another tilt belt mechanism similar to the mechanism in FIGS. 9A and 9B in accordance with further embodiments.
Figure 10B:
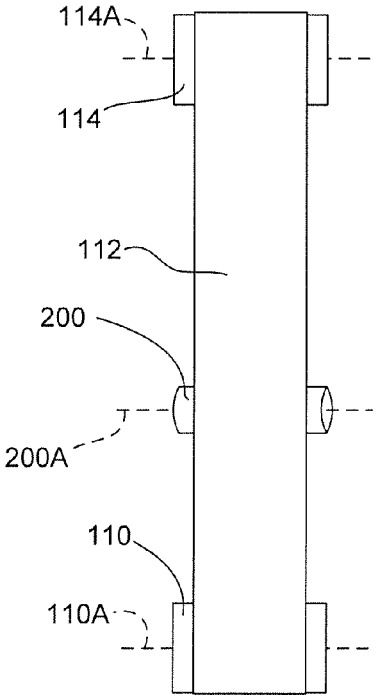
Figure 10C:
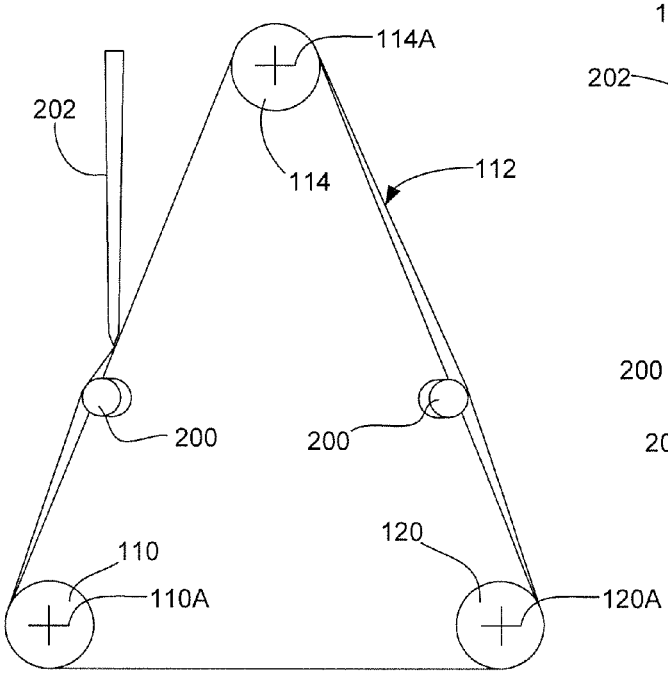
Figure 10D:
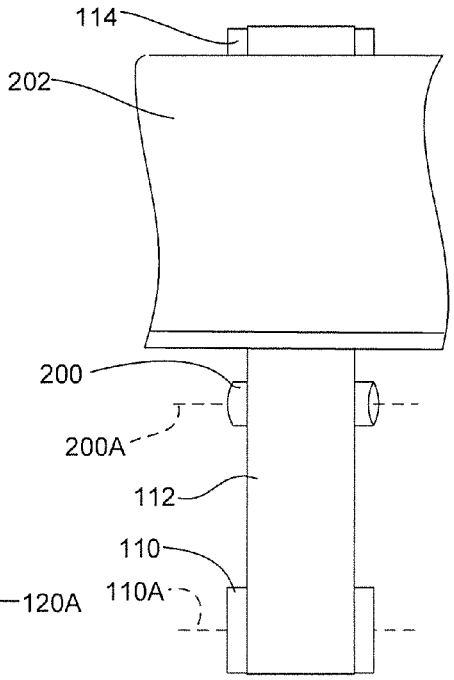

FIGS. 10A and 10B show the sharpener in an unloaded condition. FIGS. 10C and 10D show corresponding views of the sharpener in a loaded condition (e.g., with the presentation of a knife blade 202).

As shown by FIGS. 10A and 10B, two (2) rotatable support rollers 200 are used to provide double sided sharpening configurations in opposing guide slots (not separately shown) in a triangular belt path arrangement similar to that discussed above in FIG. 2A. Each of the rotatable support members 200 is characterized as a cylindrically shaped roller, although other configurations can be used.

For example, in an alternative embodiment, each support member 200 has a tapered (e.g., frusto-conical) shape so that the support varies in a direction toward the rear edge of the belt. Other shapes can be used such as crowned rollers, etc. While the support rollers 200 extend across the full width of the belt 112, this is merely exemplary and is not limiting. In other embodiments, the support rollers 200 may extend less than a full width across the belt.

The roller axes 200A of the support rollers 200 are skewed inwardly from the front edge to the rear edge of the belt so as to be non-parallel with the roller axes 110A, 114A and 120A of the belt rollers 110, 114 and 120. The amount of skew of the support roller axes 200A can vary, but may be on the order of from about 5-15 degrees with respect to the belt roller axes 110A, 114A and 120A. This induces a localized increase in the surface pressure of the belt 112 upon each roller 200 toward the front edge, as depicted by force vectors 204 in FIG. 11A.

Figure 11A:
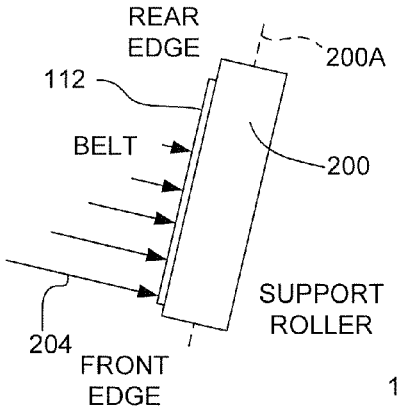
FIGS. 11A through 11C show aspects of the tilt belt mechanism of FIGS. 10A-10D in greater detail.

The force vectors 204 in FIG. 11A represent a variable force that is applied across the width of the belt 112, from a largest amount of force being applied adjacent the front edge and successively smaller amounts of force being applied in a direction away from the front edge and toward the rear edge. The actual extent and rate of change of the applied force in a given system will depend on a number of factors relating to the belt, tensioner, radius and location of the support roller, skew angle of the support roller, etc. For purposes of clarity, it will be noted that the view provided in FIG. 11A is generally a top down view of the left-side support roller 200 (see FIG. 10C) with the belt in cross section at the point of contact against the support roller.

Figure 11B:
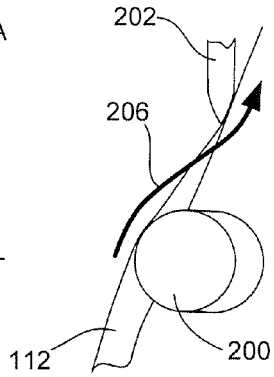

FIG. 11B shows the loaded (e.g., sharpening) condition of FIG. 10C in greater detail. Placing the support roller 200 adjacent and below the contact location for the cutting edge of the knife blade 202 against the belt 112 induces a localized, generally S-shaped serpentine path (indicated generally by path 206) for the belt.

More specifically, this serpentine path 206 is caused by passage of the belt 112 over the skewed support roller 200, which induces a small amount of twist in the belt, with less belt deflection adjacent the front edge of the belt and greater belt deflection adjacent the rear edge of the belt. The belt continues to pass upwardly until the belt encounters the inward side of the knife blade 202. The belt contactingly engages this inward side to perform a sharpening operation upon a cutting edge of the blade. The blade then continues to pass upwardly to upper roller 114A (see FIG. 10C).

Figure 11C:
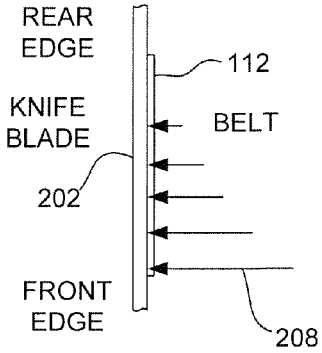

As the belt 112 engages the side of the knife blade 202, the belt induces a variable surface pressure as generally represented by force vectors 208 in FIG. 11C. As before, greater amounts of surface pressure and MTO rate are experienced along the front edge of the belt 112, and these values are reduced across the width of the belt toward the rear edge.

While the serpentine path 206 in FIG. 11B is shown to be traveling generally upwardly in FIG. 11B, it will be appreciated that the same general forces represented in FIGS. 11A and 11C will be experienced if the direction of belt travel is reversed, such as for a sharpening operation applied to the second support roller 200 on the right side of the system diagram in FIG. 10C.

Figure 12A:
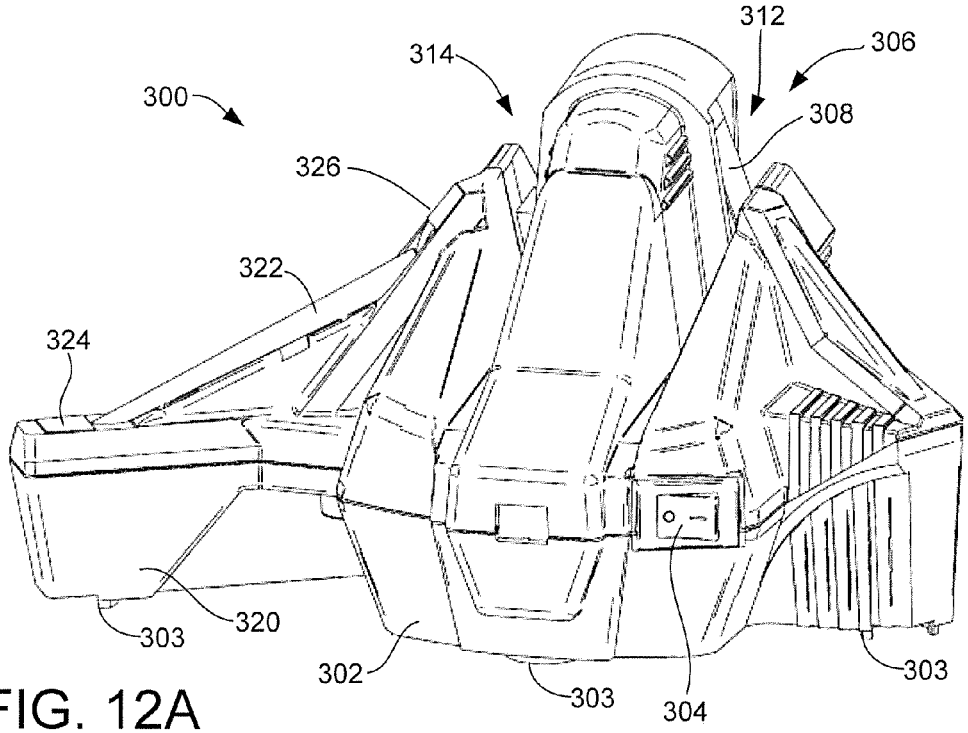
FIGS. 12A through 12D show various views of a tilted angle abrasive belt sharpener similar to the sharpener of FIG. 1 in accordance with further embodiments.
Figure 12B:
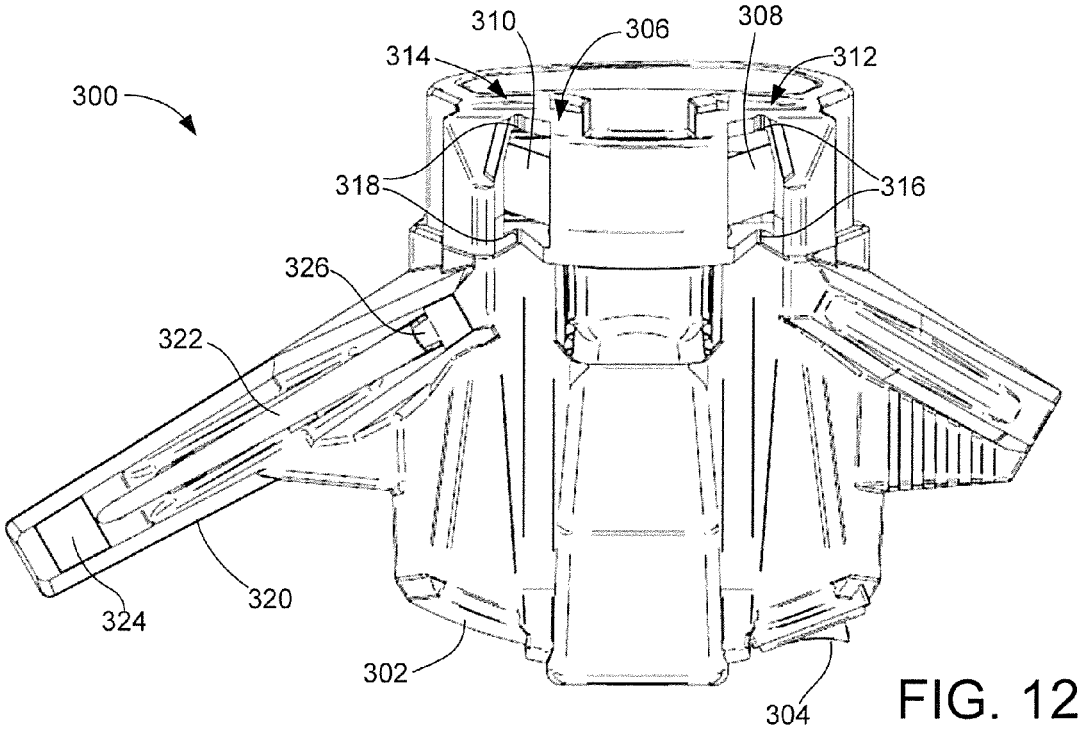
Figure 12C:
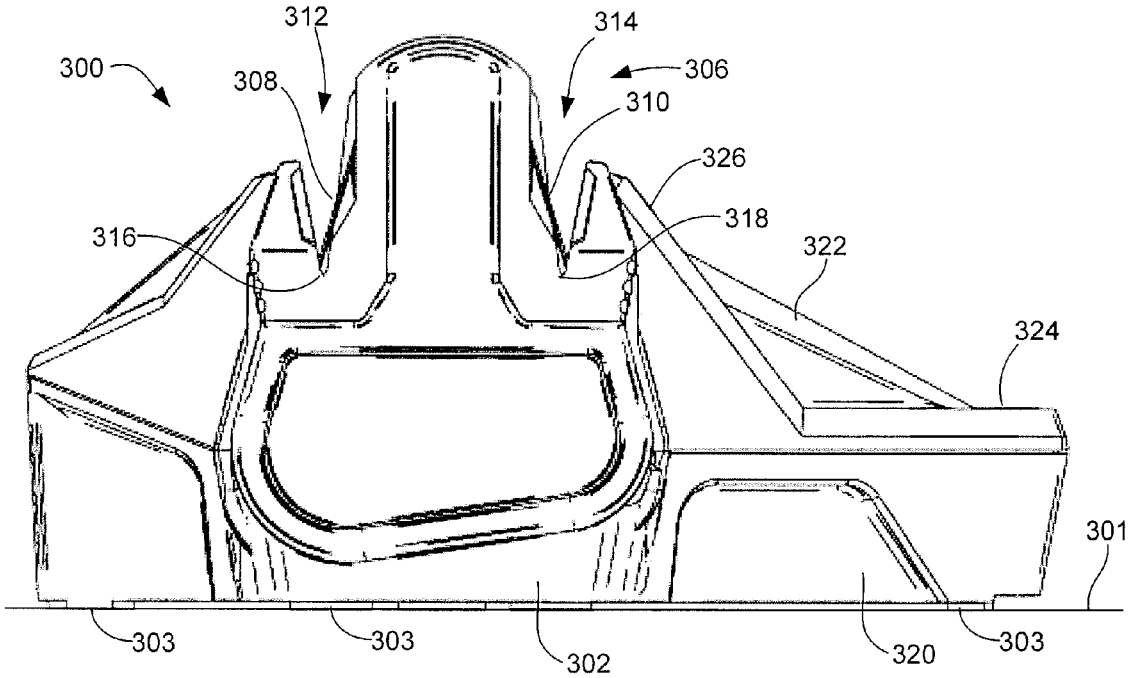
Figure 12D:
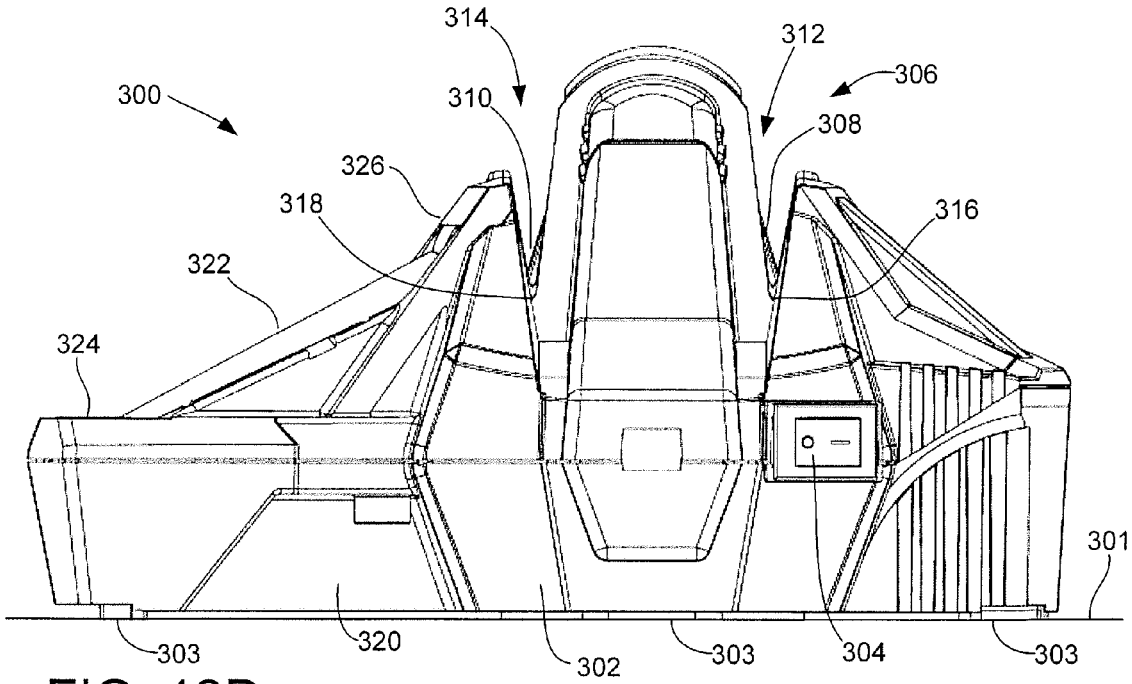

FIGS. 12A through 12D show another tilt angle abrasive belt sharpener 300 in accordance with some embodiments. The sharpener 300 is similar to the sharpener 100 discussed above. FIG. 12A is an isometric view of the sharpener 300. FIG. 12B provides a top plan view, FIG. 12C is a front (user) side view, and FIG. 12D is a rear side view.

The sharpener 300 is a powered combination sharpener configured to rest on a horizontal base surface 301 during operation. As explained below, the sharpener 300 includes an endless abrasive belt that is driven along three rollers in a manner as discussed above in FIG. 2 to provide a triangular belt path. The roller axes are parallel and are each tilted forward in a manner similar to that shown in FIGS. 3 and 4, so that the belt cants forward at a selected non-orthogonal angle A on the order of about 15 degrees (see e.g., FIG. 3).

An internal motor rotates the belt along the belt path. The motor may be mounted at the same tilt angle so that an output drive shaft of the motor is parallel to the roller axes and non-parallel to the horizontal direction. Alternatively, an internal linkage system can be used to link a horizontally disposed motor drive shaft to the non-horizontal roller axes. The sharpener further utilizes stationary guide slots with edge guide surfaces that are arranged in a horizontal fashion, as generally depicted in FIG. 7.

Referring now specifically to FIGS. 12A-12D, the sharpener 300 has a rigid housing 302 formed of a suitable material, such as injection molded plastic, and encloses various elements of interest such as the motor, transfer assembly, rollers, control electronics, etc. The housing 302 includes a plurality of spaced apart base support contact features (e.g., pads) 303 configured to provide stable support of the housing on the underlying horizontal base surface 301. A user activated power on/off switch is shown at 304.

An endless abrasive belt 306 is partially enclosed by the housing 302. Linear extents 308, 310 of the belt are exposed adjacent corresponding guide slots 312, 314 (best viewed in FIG. 12B). The guide slots 312, 314 are substantially v-shaped in a manner similar to that shown above in FIG. 7E and include horizontally aligned, bottom edge surfaces 316, 318 in each of the guide slots 312, 314. The belt 306 is tilted forward approximately 15 degrees with respect to the horizontal base surface 301; stated another way, the roller axes of the rollers disposed within the housing 302 and about which the belt 306 passes are skewed (nonparallel) with the horizontal plane established by the support contact features 303 by about 15 degrees.

To sharpen a cutting tool such as a kitchen knife, the user activates the sharpener 300 using the switch 304. While facing the front side of the sharpener (e.g., FIG. 12C), the user grasps the handle of the knife, places the blade into a selected guide slot (e.g., slot 312) so that the cutting edge rests on the bottom edge surface (e.g., edge surface 316) and the side of the blade contacts the belt 306 (e.g., belt extent 308) nearest the handle. The configuration of the guide slot will ensure the desired tilt and bevel angles are maintained. The user withdraws the knife across the belt while maintaining contact with the edge surface. To the extent that the knife has a curvilinear cutting edge, the user may raise the handle during this backward stroke to maintain contact between the cutting edge and the edge guide surfaces 316.

The foregoing process may be repeated a suitable number of times, such as 3-5 times. This applies a primary sharpening operation to one side of the knife. The user then places the knife in the other slot (e.g., slot 314) and repeats. This completes the primary sharpening operation to the other side of the knife, producing a sharpened cutting edge. The tilt angle configuration of the sharpener will provide enhanced surface pressure and MTO control, and tip rounding will be avoided.

Continuing with FIGS. 12A-12D, a leg portion of the housing 302 is generally represented at 320. This leg portion 320 extends from the main body of the housing to support a secondary abrasive member 322. The secondary abrasive member 322 comprises a stationary ceramic abrasive rod, although other forms of abrasive members can be used. The abrasive rod 322 is tapered and is disposed at a selected angle with respect to horizontal (in this case, about 30 degrees). Guide surfaces 324, 326 are disposed at each end of the rod 322. The tapered shape allows large or small serrations to be individually sharpened as desired.

In some cases, the user may elect to perform a secondary sharpening operation upon the knife using the abrasive rod. This is carried out by placing the side of the blade against a selected one of the guide surfaces (such as the surface 324) to establish a desired orientation angle of the blade with respect to the rod 322. Once oriented, the user advances the blade along the rod while retracting the cutting edge thereacross, maintaining the angular orientation established by the guide surface. This can be repeated a number of times, such as 3-5 times, after which the process may be repeated using the other guide surface (e.g., surface 326). This applies a secondary honing operation to further sharpen the knife. In this way, the sharpening applied against the rod 322 is similar to sharpening applied using a steel-type sharpener.

In some cases, the primary sharpening angle applied to the blade by the belt 306 may be a first value, such as nominally 20 degrees, and the secondary sharpening angle applied to the blade by the rod 322 may be a second value, such as nominally 25 degrees. This allows the blade to be configured with a micro-beveled geometry to enhance sharpness and durability. Touch up sharpening may be applied using just the ceramic rod 322 as desired. Sharpening may be applied by the belt without the use of the ceramic rod.

Figure 13A:
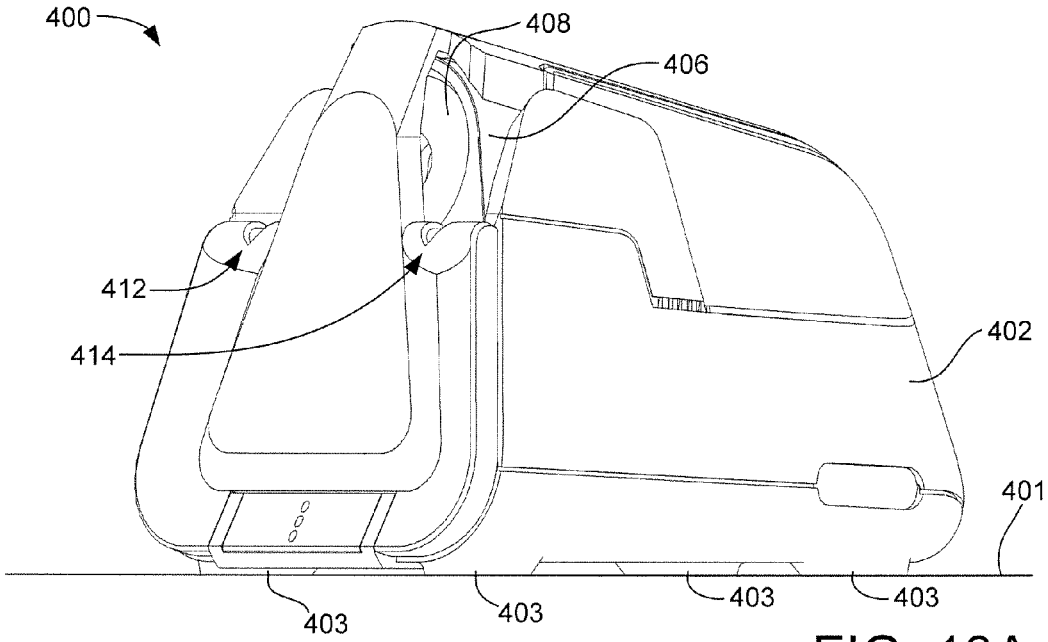
FIGS. 13A and 13B show various views of a tilted angle abrasive belt sharpener similar to the sharpener of FIG. 12A-12D in accordance with further embodiments.
Figure 13B:
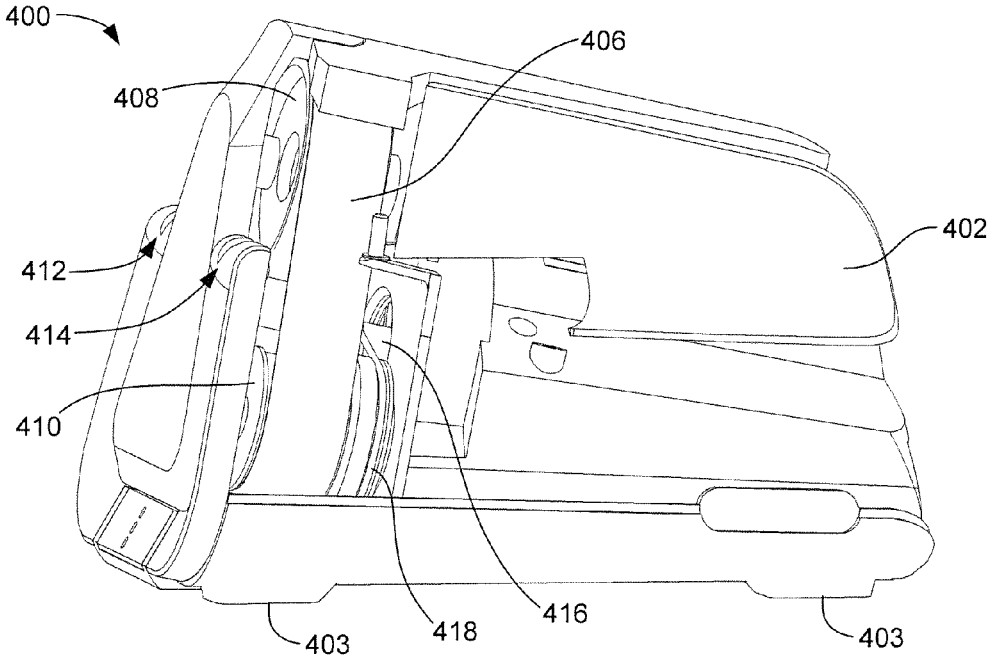

FIGS. 13A and 13B show yet another tilt angle abrasive belt sharpener 400 in accordance with some embodiments. The sharpener 400 is similar to the sharpener 300 discussed above. FIG. 13A is an isometric view of the sharpener 400 from one vantage point, and FIG. 13B is an isometric view of the sharpener 400 from another vantage point and is partially cutaway to show selected interior components of interest.

As with the sharpener 300, the sharpener 400 is a powered sharpener configured to rest on a horizontal base surface 401 during operation. Generally, an endless abrasive belt is driven along a triangular belt path over three internally disposed rollers that are parallel with each other and are each tilted forward at a selected non-orthogonal angle with respect to the horizontal direction. An internal motor rotates the belt along the belt path, and includes an output drive shaft that is parallel to the roller axes and non-parallel to the horizontal direction. Guide slots are arranged with stationary, horizontal edge guide surfaces to provide non-orthogonal angles with respect to the belt roller axes.

With reference now to FIGS. 13A and 13B, a rigid housing 402 encloses various elements of interest such as the motor, transfer assembly, rollers, control electronics, etc. Base support contact features (e.g., pads) 403 extend from the housing 402 and are aligned along a horizontal plane to rest on the base surface 401.

An endless abrasive belt 406 is routed along a plurality of rollers, including rollers 408, 410. Opposing guide slots 412, 414 operate as before to enable a user to carry out modified slack-belt sharpening on opposing distal extents of the belt. An interior motor drive assembly 416 transfers rotational power to the drive roller 410 from the interior motor via a drive belt 418.

Powered sharpeners such as those discussed above will tend to generate and expel debris during the sharpening process. The debris may be in the form of fine chips or filings that are removed from the workpiece (cutting tool), as well as loose or spent abrasive particles from the abrasive surface. This combination of debris is commonly referred to as swarf.

The swarf is made up of small particles that can be both very hard and very sharp. A buildup of swarf can reduce the operational life and performance of the sharpener through such effects as abrasion of bearing surfaces, electrically shorting of components, etc. Loose swarf also tends to damage the workpiece through unintended secondary abrasion by particles collecting on guiding or clamping surfaces held in contact with the workpiece. These particles can be expelled from the machine resulting in a mess and damage of surrounding surfaces or equipment.

Accordingly, the sharpener 400 incorporates a swarf management system to direct the generated swarf away from the sharpening area and the user. Similar swarf management systems can be adapted into other powered sharpeners including the exemplary sharpeners 100, 200 and 300 discussed above.

As explained below, the swarf management system can be configured to include a number of internal cavities within the sharpener, an impeller fan that is driven by the motor to establish an internal airflow through these internal cavities, a number of magnets to collect magnetic swarf, and a filter material to filter out fine particulates and retain the accumulated swarf within the unit.

In the current embodiment, three cavities are designed to impart the desired flow rate, velocity and/or pressures to a volume of air being moved by the fan. These cavities are referred to as a grind cavity, a filter cavity and an exhaust cavity. The magnets are located in the filter cavity and serve to remove coarse magnetic swarf from the air flow and retain the magnetic swarf for storage. The filter forms the interface between the filter cavity and the exhaust cavity, and operates to remove both magnetic and non-magnetic particles that were not captured by the magnets.

The grind cavity is provided adjacent the sharpening operation. Airborne swarf is directed internally from the grind cavity into the filter cavity using an intake opening adjacent the fan. The intake opening is sized appropriately to provide high air velocity to keep the swarf suspended in the air flow.

The filter cavity ideally has a cross section substantially larger than the intake opening to allow for the air velocity to drop substantially. This permits the majority of swarf to fall out of the air flow and be retained by and/or adjacent the magnet(s). The magnet(s) are suspended and spaced apart to allow for a large accumulation of swarf.

The filter is of a sufficiently large surface area to provide for the desired flow rate as airflow passes from the filter cavity to the exhaust cavity. The filter is ideally place horizontally or on an incline above the magnets and filter cavity. This facilitates "self-cleaning" by dislodging particles with normal vibrations/movement of the sharpener where gravity will pull the dislodged particles down to be retained by the magnets. Other configurations can be used, however. The exhaust cavity terminates in a series of exhaust openings that enable clean airflow to exit the sharpener, such as at a rear side of the unit away from the user.

Figure 14:
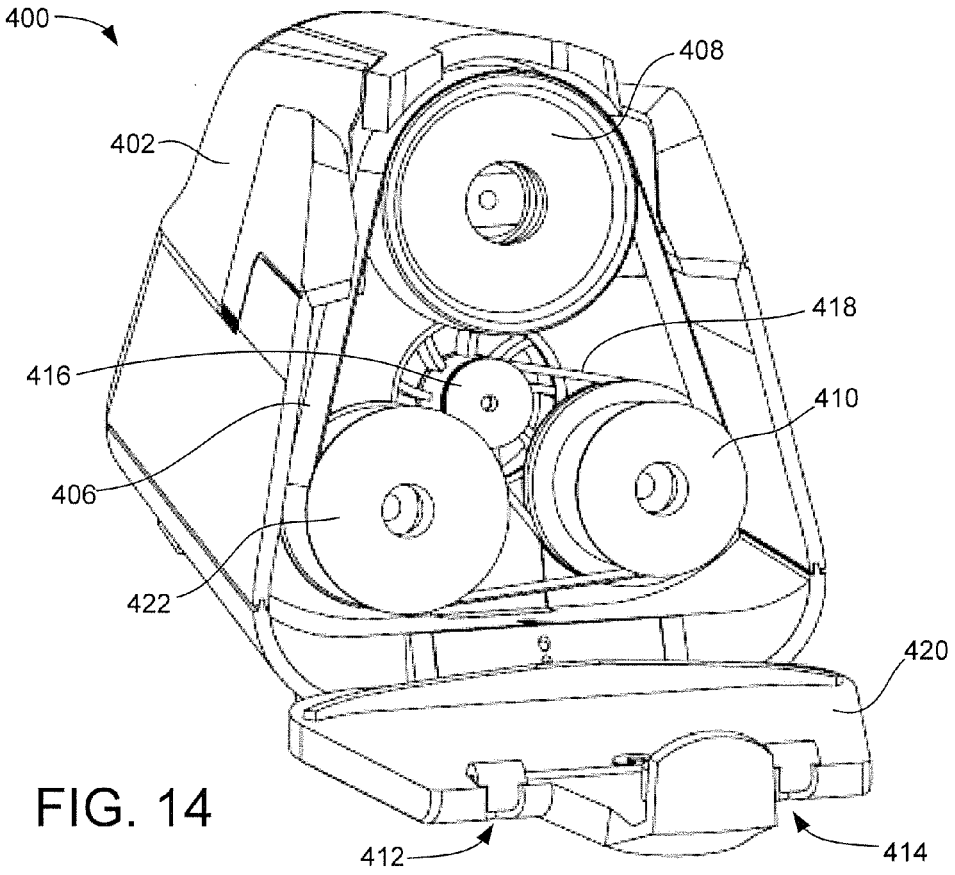
FIG. 14 shows the tilted angle abrasive sharpener of FIGS. 13A-13B in greater detail.

FIG. 14 shows a front isometric view of the sharpener 400 to show these and other aspects of the swarf management system. It will be appreciated that the swarf management system can readily be incorporated into other forms of powered sharpeners, including sharpeners that use other abrasive members (e.g., abrasive discs, etc.) as well as belt sharpeners that do not necessarily include the tilt belt sharpening features described above.

A hinged front cover 420 has been rotated to an open position to reveal various components of interest. The belt 406 is shown routed around the previously described rollers 408 and 410, as well as a third roller 422. Any number of rollers and belt path configurations can be used, including the use of a greater number or lesser number of rollers as desired. As noted previously, drive belt 418 extends from the drive assembly 416 to the drive roller 410, and the drive roller 410 in turn drives the belt 408 about the rollers 408 and 422.

Figure 15A:
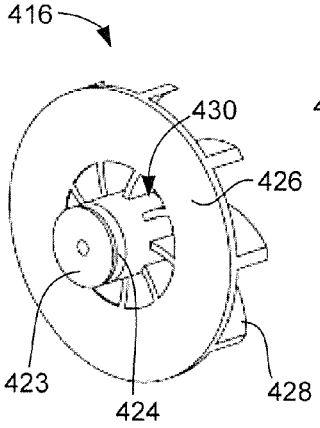
FIGS. 15A through 15C show a fan impeller assembly of the sharpener of FIG. 14 in accordance with some embodiments.
Figure 15B:
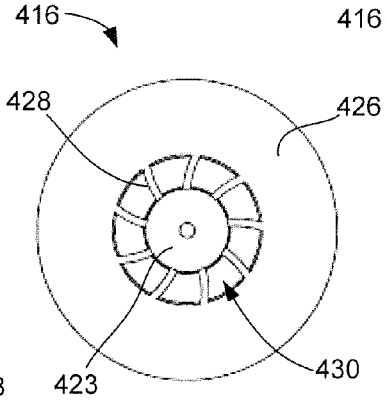
Figure 15C:
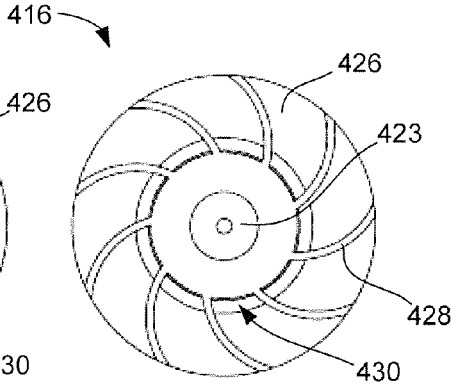

The drive assembly 416 is shown in greater detail in FIGS. 15A-15C to include a fan assembly, also referred to as an impeller assembly. A central hub or roller 423 is axially aligned and driven by an interior motor shaft. The roller 423 has a groove 424 to locate and retain the drive belt 418. An annular plate 426 surrounds the central hub 423 and is connected thereto using an array of spaced-apart impeller blades 428. The blades 428 take a general spiral shape, although any suitable shape can be used as required.

A segmented central opening 430 is provided between the impeller blades 428, the central hub 423 and the plate 426. This opening provides an entry point or inlet passageway for airflow that is directed into the housing 402 during rotation of the blades.

Figure 16:
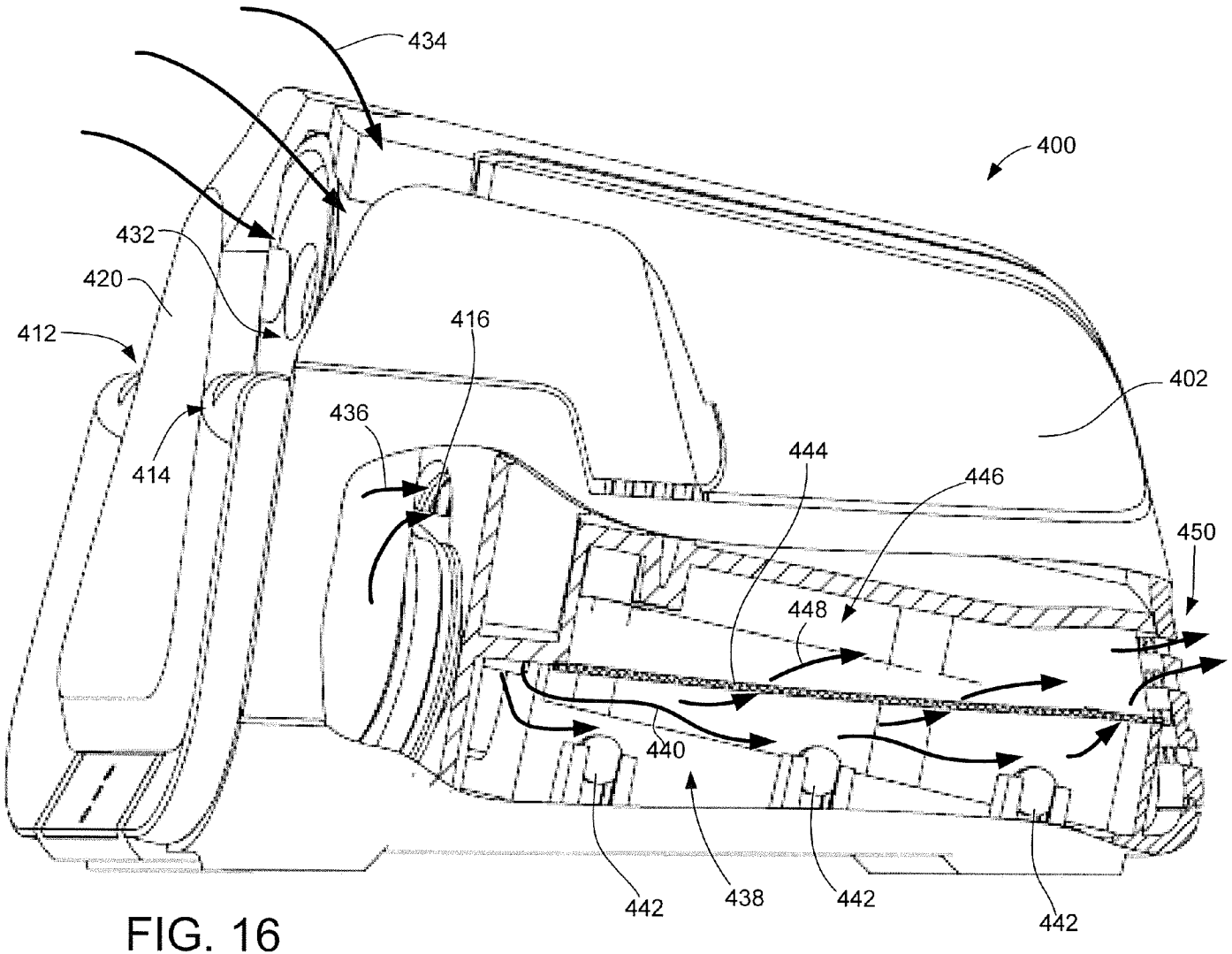
FIG. 16 is a partial cut-away view of the sharpener of FIG. 14 to illustrate aspects of a swarf management system in accordance with some embodiments.

FIG. 16 shows a cut-away view of the sharpener 400 to show additional details of the swarf management system in accordance with some embodiments. The cover 420 is shown in FIG. 16 to be in the upright, closed position to partially enclose the aforementioned belt 406 and rollers 408, 410 and 422. A grind cavity 432 generally denotes this interior area behind the closed cover 420 in the vicinity of the belt.

During a sharpening operation, rotation of the fan assembly 416 will draw an initial airflow into the grind cavity 432, as indicated by arrows 434. A portion of this airflow will be directed through the opening 430 in the fan assembly, as indicated by arrows 436. The location of the opening 430 proximate the sharpening guides 412, 414 will tend to ensure that a majority of the swarf generated by the sharpening process will be drawn through the opening.

Disposed within the housing 402 of the sharpener is a relatively large, elongated filter cavity 438. The airflow 436 exiting the fan assembly 416 passes into a first end of the filter cavity 438, as indicated by arrows 440. The increase in cross-sectional area from the opening 430 to the cavity 438 induces a reduction in airflow velocity and/or pressure, enabling heavier swarf particles to drop to a lower portion of the filter cavity.

Magnets 442 are located along the lower portion of the filter cavity to further attract and retain magnetic particles within the airborne swarf. While three (3) magnets 442 are shown, other numbers of magnets can be used, including arrangements that do not use any magnets. Other attraction and retention mechanisms for the swarf can be used as desired.

A filter membrane 444 extends along an interior of the housing 402 to form an upper boundary of the filter cavity 438 and a lower boundary of an exhaust cavity 446. As depicted in FIG. 16, the airflow passes along the filter cavity 438 and moves upwardly through the filter membrane 444. The filter membrane 444 is sized to permit sufficient airflow through the unit while substantially preventing any remaining airborne swarf from passing from the filter cavity 438 to the exhaust cavity 446. In this way, a substantially clean exhaust airflow passes into the exhaust cavity, as indicated by arrows 448, and this airflow passes out an array of exhaust openings 450 that extend through a rear portion of the housing 402. This arrangement allows the filter 444 to be located in the outer enclosure (when the design permits a large area) so that the air exiting the filter is immediately expelled from the machine.

It is beneficial if the rotational speed of the fan assembly 416 is greater than the speed of the abrasive 408. This permits the air velocity to be substantial larger than the velocity of loose swarf released during grinding. The fan may be driven by a separate motor than the grind motor. Alternatively, the system may utilize a speed change mechanism to increase the fan speed or reduce the abrasive speed.

The fan/motor may be located in any of the cavities in this process or externally at the exhaust location. The cavities may be have negative or positive pressure depending on the location of the fan. The design of the fan/impeller will be chosen to fit the application to account for suction, blowing, or mixed flow as shown. These and other considerations will readily occur to the skilled artisan in view of the present disclosure, and any number of different configurations can be designed based thereon.

Figure 17A:
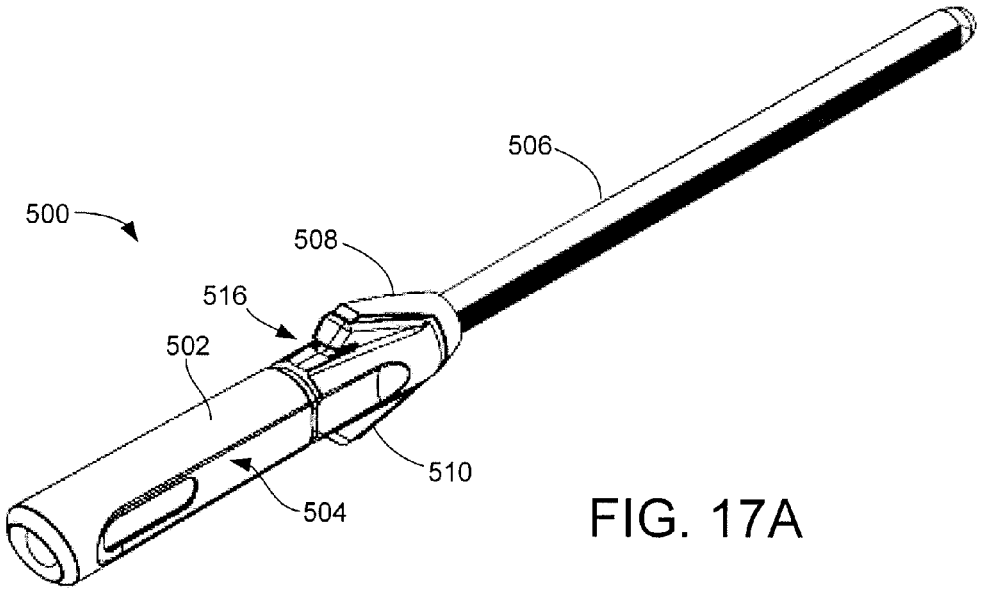
FIGS. 17A through 17C show a hand held manual sharpener in accordance with further embodiments of the present disclosure.
Figure 17B:
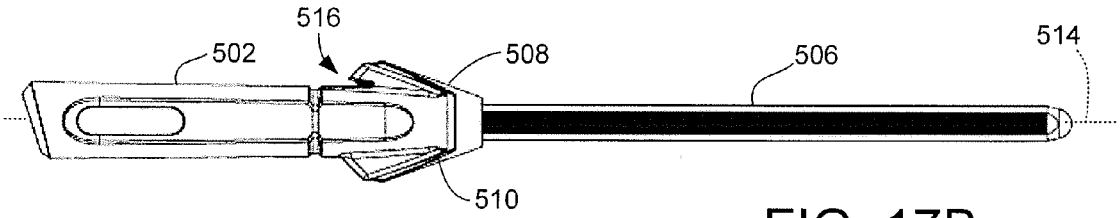

FIGS. 17A-17B show another sharpener 500 that may be utilized in accordance with some embodiments. The sharpener 500 is characterized as a hand-held or manual sharpener. In some cases, a powered sharpener such as 100, 200, 300, 400 may be utilized in conjunction with the manual sharpener 500, so that a given cutting tool is initially sharpened using the powered sharpener, followed by additional processing being applied to a cutting edge of the tool using the manual sharpener.

The sharpener 500 is a steel-type sharpener with a user handle 502 with an outer grip surface 504 adapted to be grasped by the hand of the user. An abrasive rod 506 extends from a selected end of the handle 502. As best viewed in FIG. 17B, the handle includes opposing first and second guide surfaces 508, 510 which extend linearly at a selected angle with respect to the abrasive rod 506, such as about 25 degrees with respect to a central longitudinal axis 514 that passes through the handle 502 and the rod 506. Other angles can be used, including different angles for each of the different guide surfaces 508, 510. Suitable angle values may range from about 15-25 degrees.

The guide surfaces 508, 510 are configured to provide a line contact alignment of a side of the cutting tool, such a side of a blade of a kitchen knife. This allows a user to orient the tool at the guide angle, and then advance the cutting edge along an abrasive surface 512 of the abrasive rod 506 while nominally maintaining the blade at the established guide angle. The rod 506 may be rotatable with respect to the handle 502 to allow different abrasive surfaces arrayed about the outer surface of the rod to be aligned with the respective guide surfaces 508, 510.

In this way, once a tool has been sharpened using a powered sharpener (e.g., the sharpener 400), a final honing operation can be supplied to the cutting edge using the manual sharpener 500. The angle(s) of the guide surfaces 508, 510 may be greater than the angle of the guides 412, 414 in the powered sharpener 400 to impart a micro-bevel sharpening geometry to the cutting tool. In one example, the guides 412, 414 may apply an angle of about 20 degrees to the side of the blade adjacent the cutting edge, and the guide surfaces 508, 510 may provide a micro-bevel region adjacent the cutting edge of about 25 degrees.

Figure 17C:
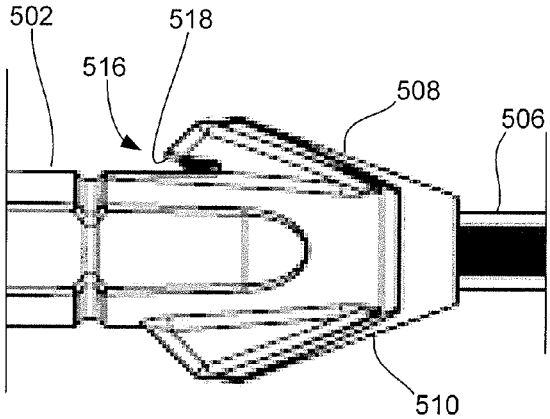
Figure 18:
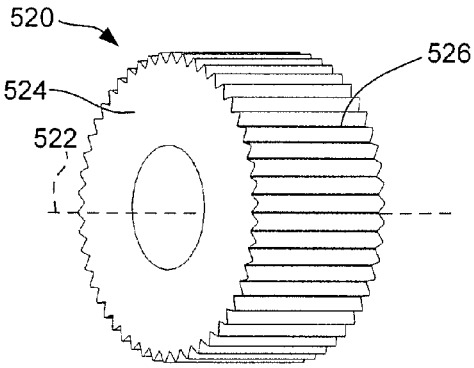
FIG. 18 shows a cold forging member in the form of a knurl roller incorporated into the sharpener of FIGS. 17A-17C.

As shown in greater detail in FIG. 17C, the sharpener 500 includes an embedded sharpening stage 516 to provide additional processing to the cutting edge of the tool. The sharpening stage 520 provides a slot that extends into the handle 502 under the guide surface 508 formed from one or more guide surfaces 518. The guide surfaces 518 orient the edge of the blade as the blade is inserted into the slot to contact a cold forging member 520, as shown in FIG. 18.

The cold forging member 520 is characterized as a knurl roller and is mounted for rotation within the handle 502 about a roller axis 522 at a suitable angle relative to the central longitudinal axis 514, as discussed below. The knurl roller 520 comprises a hard cylindrical member made of metal or other suitable material with a projection pattern about an exterior circumference thereof configured to be transferred to a corresponding workpiece upon the application of force thereto.

Figure 19A:
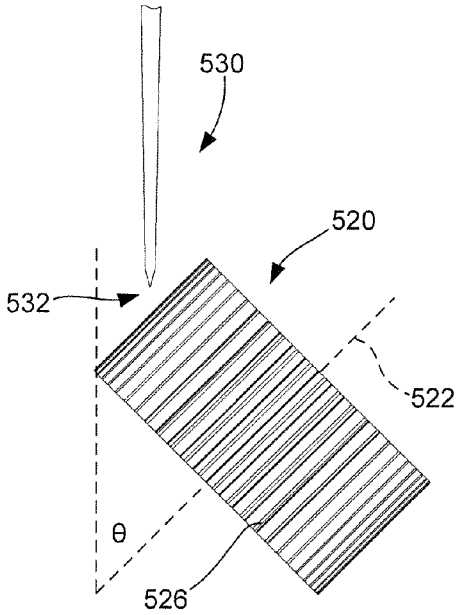
FIGS. 19A through 19C illustrate the use of the cold forging member in some embodiments.
Figure 19B:
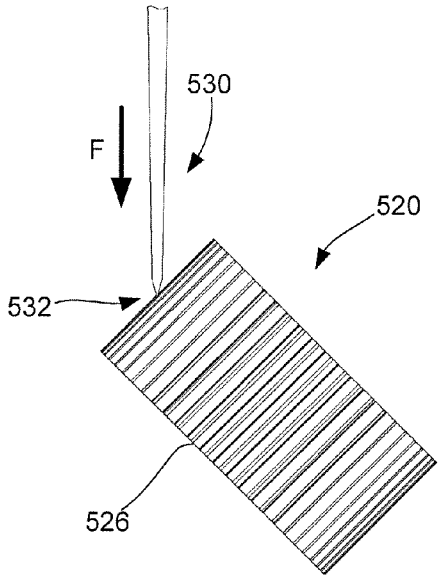
Figure 19C:
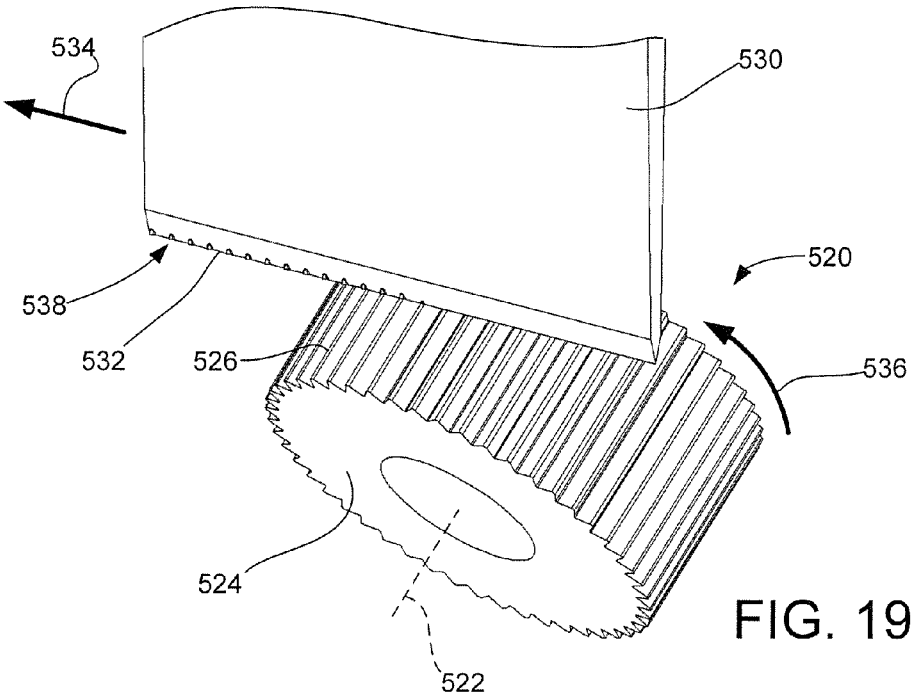

As further shown in FIGS. 19A-19C, the knurl roller 520 takes a gear configuration with a cylindrical body 524 and radially spaced, radially and longitudinally extending teeth (projections) 526. The teeth are substantially triangular in shape, although other shapes, spacings and patterns of projections can be used including irregular patterns and sequences of projections.

The knurl roller 520 forms a series of recessed channels, or notches, into a cutting edge of a tool using a cold forging process (also referred to as a roll fouling process). As shown in FIG. 19A, a blade 530 with cutting edge 532 is placed at a selected angle θ with respect to the roller axis 522, such as through insertion into the slot formed by guide surface 518 in FIG. 17C.

The blade 530 is advanced along the insertion plane established by the slot so that the cutting edge 532 contactingly engages the roller 520 via contact force F, as depicted in FIG. 19B. The blade 530 is then drawn longitudinally in direction 534 as depicted in FIG. 19C so that the roller 520 rolls along the length of the cutting edge (or a desired portion thereof). The teeth 526 of the roller 520 come into contact with, and locally deform, the cutting edge 532 as the roller 520 rotates in rotational direction 536 and the blade 530 is translated along direction 534.

The surface pressure imparted by the teeth 526 forges (deforms or displaces) the material of the blade 530 to form spaced apart projecting channels 538 along the length of the cutting edge 532. Depending on the angle θ, the magnitude of the force F and the respective material configuration of the blade and the roller, the displaced material may project beyond one or both sides of the blade. This deflected material can be maintained on the blade, or a secondary honing operation using a suitable abrasive (such as the abrasive rod 506 or belt 406) can be applied to remove the displaced material and substantially align the channel wall with the exterior tapered surfaces of the blade.

In this way, a plurality of spaced apart channels can be formed in the sharpened cutting edge by contactingly engaging the sharpened cutting edge with the cold forging member with sufficient force to displace portions of the sharpened cutting edge. This provides the channels as locally deformed, work hardened notches.

An advantage of the use of a cold forging process to form the channels is the quick and easy manner in which the features can be generated. A single pass of the blade against the knurl roller 520 (or other forging member) while applying moderate force upon the blade may be sufficient in most cases to form the respective channels. Although the applied force is light, the resulting surface pressure is relatively high because only a single projection, or a few projections, are in contact with the blade at any given time, and the projections are so small that the applied pressure is high. Secondary honing can be applied with a single or a few strokes of the blade against the abrasive rod 506 to remove the displaced material. Substantially any knife or other cutting tool can be subjected to this processing. Another advantage of cold forging is that, depending upon the material, the metal of the blade in the vicinity of the channels will tend to be work hardened, thereby providing localized zones of material with enhanced hardness and durability as the material is locally deformed.

To the extent that subsequent passes are required to re-form the channels during a subsequent resharpening operation, the knurl roller 520 will tend to align with the existing channels 538 so that the channels are formed in the same locations during subsequent cold forging passes. Such alignment has been found to occur because the distal ends of the knurl teeth 526 tend to engage the existing channels as the cutting edge 522 is drawn across the roller 520. Once engaged, the roller 520 will turn in a keyed fashion to the previously embossed pattern of channels. Any number of rollers can be concurrently applied to the blade to form different channel patterns.

In another embodiment, the blade 530 can be held stationary and the roller 520 can be rollingly advanced therealong to form the channels 538. Motive power can be applied to the blade 530 and/or the roller 520 during the channel forming process as desired. While FIGS. 19A-19C show the knurl roller 520 disposed within the handle of the hand held manual sharpener 500, in other embodiments, the roller can be disposed within the housing of a powered sharpener, such as but not limited to the powered sharpener 400.

Figure 20A:
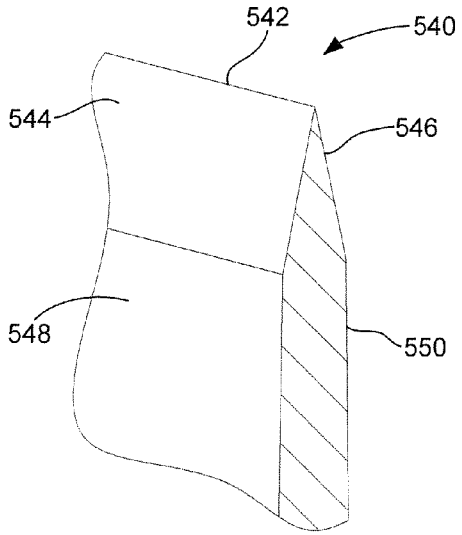
FIGS. 20A through 20E illustrate cold forged channels or notches that are formed in a cutting edge of a tool by the cold forging member.

FIGS. 20A through 20E show aspects of another blade 540 processed in accordance with FIGS. 19A-19C. FIG. 20A shows a portion of a pristine blade 540 that has been sharpened to a fine cutting edge 542 by the convergence of opposing tapered surfaces 544, 546 and primary surfaces 548, 550. Such a blade may be characterized as having a fine edge since the cutting edge 542 is substantially continuously linear or curvilinear along its length without significant deviations or discontinuities. The geometry of FIG. 20A may be achieved, for example, through the application of a powered sharpening operation using the powered sharpener 400.

Figure 20B:
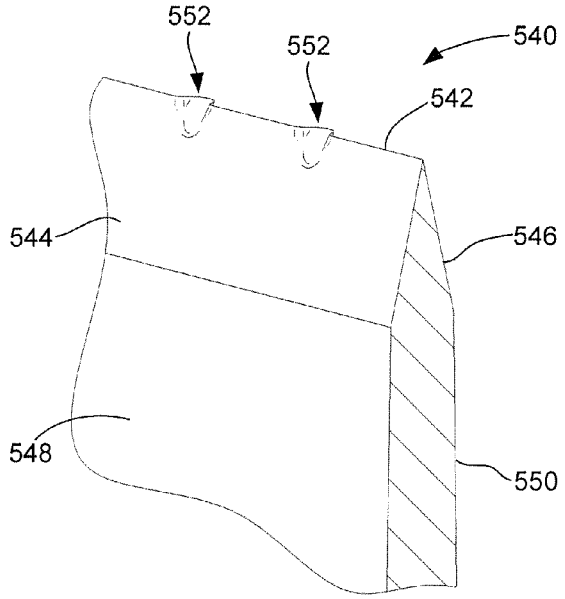

FIG. 20B shows a portion of the blade 540 after having been subjected to the cold forging operation of FIG. 19C. Cup-shaped projecting channels 552 extend through the cutting edge 542 and are formed by the localized deformation of the blade material by the roller 520. FIG. 20C shows deflected material 554 making up the projecting channels 552. The locally deformed material has been workhardened to provide a change in the crystalline structure of the cutting edge in the vicinity of the channels.

Figure 20D:
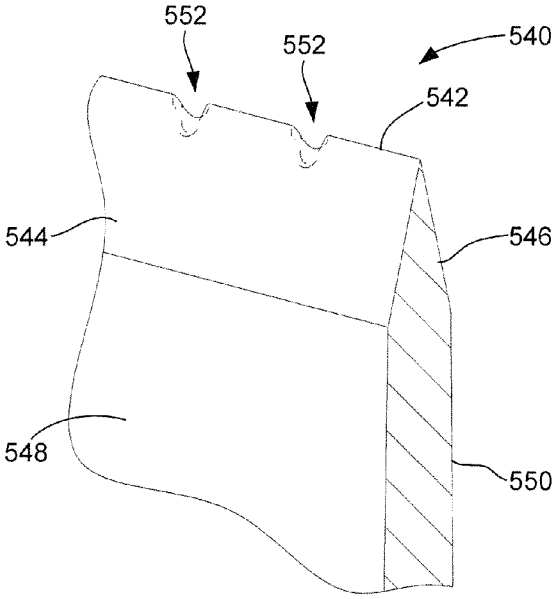
Figure 20C:
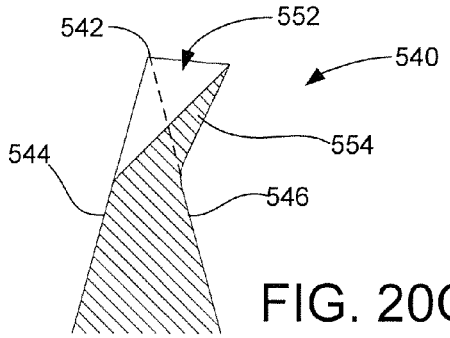
Figure 20E:
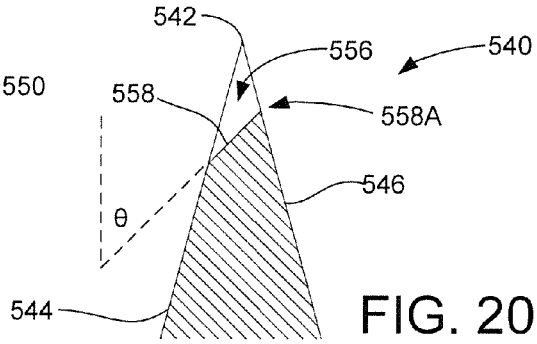

FIGS. 20D and 20E show the results of a secondary sharpening (honing) operation to substantially remove the deflected material 554. This provides shaped channels 556 with sidewalls that nominally align with the tapered surfaces 544 and 546, as best illustrated in FIG. 20E. The angle of the base surface of an interior sidewall 558 nominally corresponds to the angle θ along which the teeth 526 extend (see FIG. 19A). The honing operation exposes new recessed cutting edges, denoted at 558A. This provides recessed cutting edges along the sides of the channels that will remain sharp even if the extents of the cutting edge between adjacent channels becomes dulled, rolled over, etc.

Stated another way, the channels 556 in FIG. 20E may be thought of as generally u-shaped channels with base surfaces 558 and recessed, "shark teeth" style side surfaces 558A on each side of the base surfaces. The base surfaces 558 nominally extend along a plane that is skewed (e.g., non-parallel) to the planes along which the side surfaces 544, 546 of the blade extend, here surfaces 544, 546 intersect to form the cutting edge 542.

This honing operation may be carried out as follows. With reference again to FIG. 17B, after inserting the blade 540 into the slot adjacent guide surface 518 and pulling the blade therethrough to form the channels 552, the user can place the back side surface 550 against the guide surface 508 to orient the blade at the desired angle. The user then advances the cutting edge 542 along the top of the abrasive rod 506 while retracting the cutting edge across the rod to remove the deflected material 554.

The blade 540 retains an effective sharpness for a significantly longer time as compared to the pristine fine edge configuration of FIG. 20A. One reason is that the periodically arranged channels provide a discontinuous cutting edge, so that should the cutting edge begin to roll over at one point, this roll over will only extend to the next channel rather than extending along the full length of the edge. Another reason is that the recessed cutting surfaces 558A provide recessed "teeth" that will continue to facilitate efficient slicing and plunge cuts even as the straight portions of the cutting edge 542 between channels become dull.

FIG. 21 shows yet another tilt belt sharpener 400A. The sharpener 400A is substantially similar to the sharpener 400 discussed above in FIGS. 13A through 16, and so like components have been given the same reference numerals for convenience. The sharpener 400A includes the use of a pair of opposing platen assemblies 602 that provide localized underside support of the belt 408 during sharpening operations.

As will be recognized, it is often desirable to provide a specific shape to the bevel surfaces of a blade or other cutting tool during a sharpening operation. Convex angles can be achieved by sharpening against an unsupported or partially supported segment of an abrasive belt as discussed above. Using an unsupported extent of the belt generally allows the belt to deflect at a curvature and imparts that curvature to the side of the blade adjacent the cutting edge. As discussed above, the unsupported belt can be combined with a tensioner system, angle guide, and edge stop to accurately position the blade while providing a desired maximum sharpening force.

While being suitable for most blades and applications it is often desirable to impart other shapes such as flat or concave (hollow) grinds to the bevel. In these cases a shaped support surface, or platen assembly such as the assemblies 602 in FIG. 21, can be located behind the moving belt 408 to define the shape of the blade.

Some embodiments involving the platen assembly include a moving abrasive belt powered by an electric motor. The belt is support by a spring loaded member that provides an opposing sharpening force. The force is limited by providing a limit stop within the desired spring travel of the platen. In order for the platen to provide a specific shape to the belt it is further intended to operate in a position between two supports (rollers) and bias the belt outside of a "tangent" plane tangent to both pulleys. When the blade is inserted, the platen is allowed to move toward, and possibly up to, the tangent plane. The travel is limited by a depth limit stop to insure the belt doesn't deflect beyond the tangent plane thereby; limiting the maximum force applied and ensuring the belt is still in conformance to the platen so than the desired bevel shape is imparted to the blade.

Referring again to FIG. 21, each platen assembly 602 includes a platen member, or plunger 604, a base support 606 and a biasing member 608. The biasing members 608 each take the form of a coiled spring, although other biasing mechanisms can be used. The biasing members 608 apply biasing forces to urge the platen members 604 against the back surface of the abrasive belt 406 in the vicinity of the respective sharpening guide slots (412 and 414).

FIGS. 22A through 22E show various aspects of the platen members 604 in greater detail. FIG. 22A is a front facing view of a selected platen member 604, and FIG. 22B is a side view of the selected platen member. The selected platen member 604 includes a platen head 610 affixed to a cylindrical shaft 612.

The shaft 612 passes through an aperture in the associated base 606 (FIG. 21) and the associated biasing member 608 surrounds the shaft and exerts the biasing force between an upper surface of the base and a lower surface of the head. While the shaft 612 is shown to be cylindrical, other shapes can be used including a keyed shape to reduce rotation of the head 610 relative to the belt 406. As noted above, a retention flange or other mechanism (not separately shown) can further be used to retain a distal end of the shaft 612 in the associated base 606 and limit the maximum travel of the platen head.

The head 610 in FIGS. 22A and 22B includes a flat platen surface 614. The mounting angle and orientation of the surface 614 may be selected to nominally match the angle along which each tangent (planar) extent of the belt 406 passes; more particularly, FIG. 21 shows a first planar extent 406A that extends between rollers 408 and 422, and a second planar extent 406B that extends between rollers 408 and 410. It will be noted that the biasing members 608 advance these extents, or sections of the belt 406, forward past a flat tangential plane that would otherwise be present in the absence of the platen assemblies 602.

The flat platen surface 614 generally operates to apply a flat grind geometry to the sides of the blade in the vicinity of the cutting edge during a sharpening operation. FIG. 22C shows an alternative platen member 604A similar to the platen member 604 in FIGS. 22A and 22B. The platen member 604A has a convex (curvilinearly shaped) platen surface 614A. The convex surface operates to apply a hollow grind geometry to the sides of the blade. Other shapes can be used, including a concave shape.

Because of the additional support supplied to the underside of the belt 406 by the respective platen assemblies 602, it is contemplated that enhanced heating due to friction may be generated during the sharpening assembly. As desired, air cooling fins 616 may be applied such as shown in FIG. 22C to a back surface of the platen head 610. Similar fins may be affixed to the flat platen head 610 in FIGS. 22A-22B. A forced air system such as provided by the impeller assembly 416 can be used to draw cooling air across the fins to remove heat. The fins can be oriented appropriately as required in relation to the designed air flow direction.

FIG. 22D shows a top view representation of the platen member 604 of FIG. 22A. For reference, the view in FIG. 22D shows the sloping flat surface 614, and orients a top surface 618 of the head 610 at the top of the figure. In this orientation, it can be seen that the platen assembly 602 applies a uniform force against the belt 406 from the front edge to the rear edge (see e.g., FIG. 5).

FIG. 22E shows an alternative top view representation of another platen member 604B. In this case, the flat surface 614 slopes both in a direction parallel to the direction of belt travel as well as across the belt from the front edge to the rear edge. In this way, the platen assembly 602 can be configured to provide different amounts of backside support to the belt in a manner similar to that discussed above in FIGS. 9A to 11C.

Figure 23:
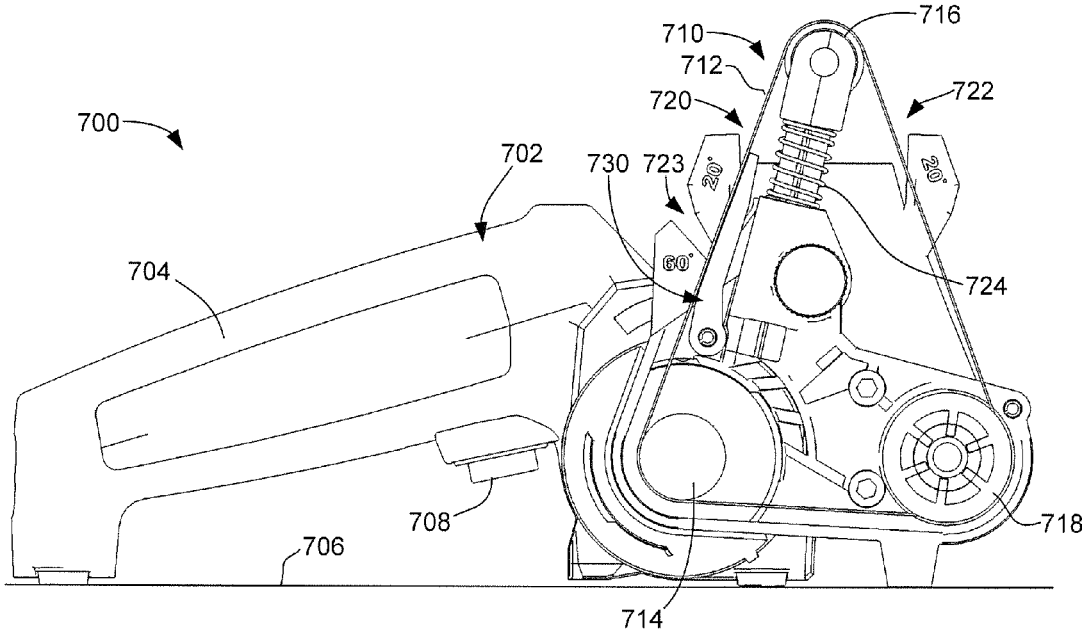
FIG. 23 shows another sharpener with a platen assembly in accordance with further embodiments.

FIG. 23 shows yet another powered sharpener 700 constructed and operated in accordance with some embodiments. The sharpener 700 includes a main housing 702 with a user handle portion 704 configured to be gripped by the hand of a user. The housing 702 can be supported on an underlying surface 706 or held in free space as desired.

The housing houses an interior, transverse mounted electric motor (not separately shown). A user activated trigger or activation button 708 can be applied to control the rotation of the motor.

A sharpening assembly 710 is attached to the housing and includes an abrasive belt 712 that is routed along a belt path that passes about a drive roller 714 and a pair of idler rollers 716, 718. While three (3) rollers are shown, any suitable number of rollers can be used including less than, or more than, three rollers. As before, the belt path provides a pair of opposing tangent (planar) extents against which a cutting tool can be sharpened using opposing guides 720, 722. The sharpening guides 720, 722 are mirrored and both impart a common grinding angle to the cutting tool, such as nominally 20 degrees. A third sharpening guide 723 can also be provided to sharpen at a different angle, such as nominally 60 degrees. The guides 720, 722 may be suitable for knives and the like, and the guide 723 may be suitable for sharpening scissors and the like. The upper idler roller 716 is configured as a tensioner roller with a biasing member 724 to maintain a desired tension in the belt 712 as the belt is deformed out of the associated extent during sharpening.

Figure 24A:
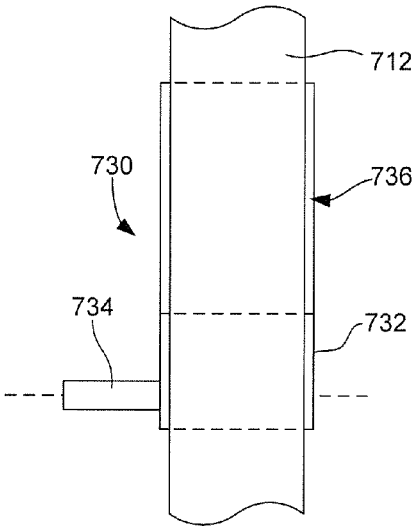
FIGS. 24A through 24C show further aspects of the platen assembly of FIG. 23 in various embodiments.
Figure 24B:
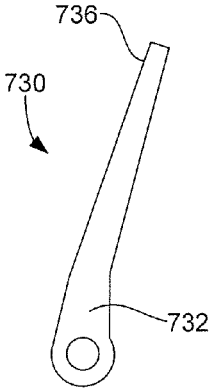
Figure 24C:
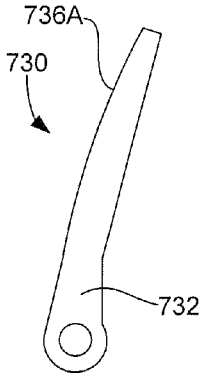

The sharpener 700 includes a platen assembly 730 adjacent the sharpening guides 720, 723. An opposing, second platen assembly can be supplied adjacent the sharpening guide 722, although such is not depicted in FIG. 23. As further shown in FIGS. 24A and 24B, the platen assembly 730 includes a main platen body 732 adapted for rotation about a stationary shaft 734 in a flapper or hinged configuration. A spring or other biasing member (not separately shown) can be used to urge a platen surface 736 against the back side of the belt 712 in the manner shown in FIG. 23. The platen surface 736 can be flat as depicted in FIG. 24B, or can take other shapes such as a convex shape as depicted at 736A in FIG. 24C.

Figure 25A:
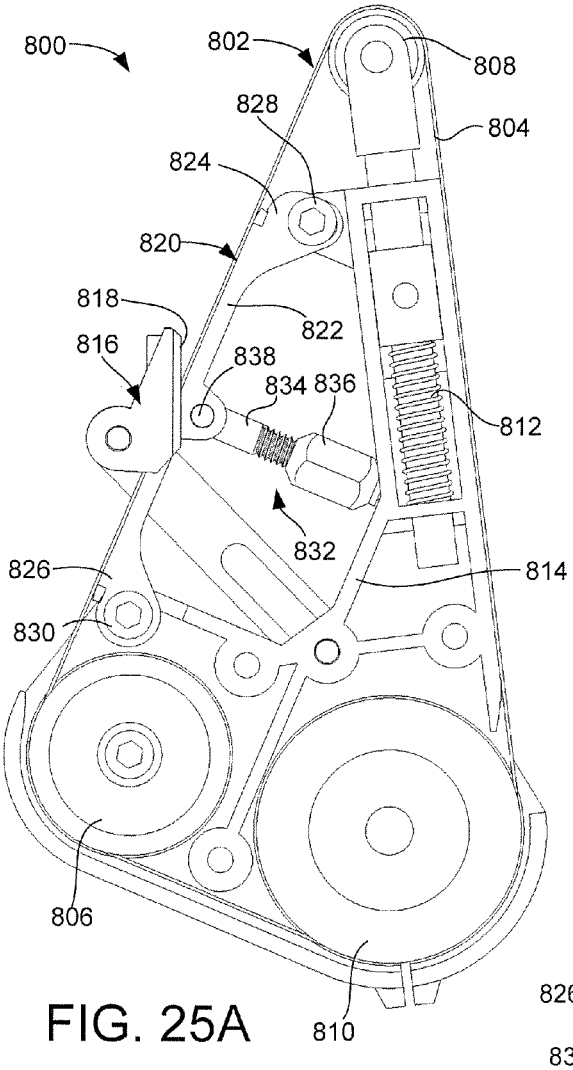
FIGS. 25A through 25C show further aspects of a sharpener with a platen assembly in accordance with further embodiments.
Figure 25B:
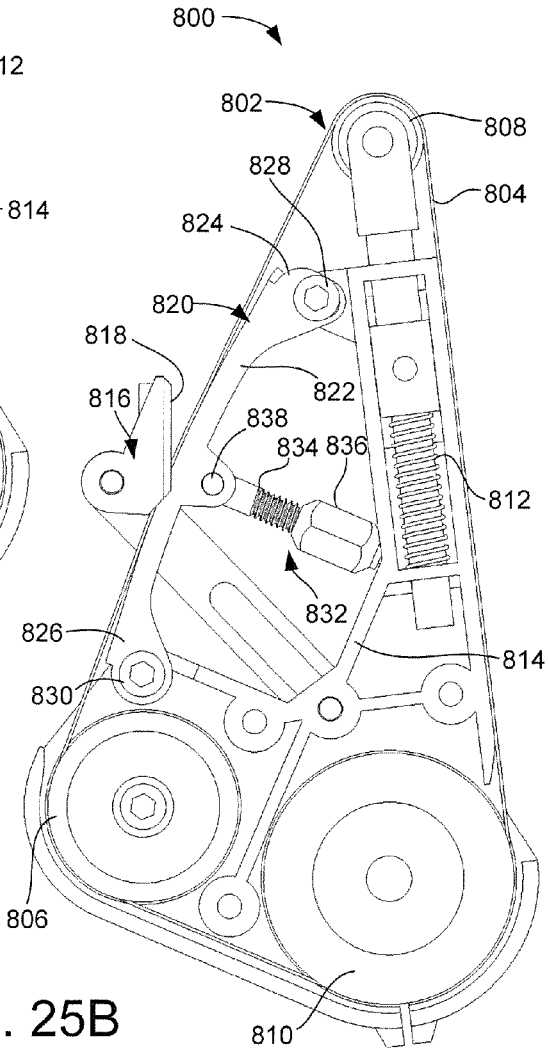

FIGS. 25A and 25B show aspects of yet another sharpener 800 in accordance with further embodiments. The sharpener 800 provides a sharpening assembly 802 that can be affixed to a base sharpener, such as the sharpener 700 of FIG. 23. As before, the assembly 802 provides an abrasive belt 804 routed in a generally triangular path about a drive roller 806 and idler rollers 808, 810. The idler roller 808 is configured as a tensioner roller with biasing spring 812 to maintain a desired level of tension in the belt.

The respective rollers 806, 808 and 810 are supported by an interior frame 814. The frame 814 maintains the rollers in the relative fixed positions shown in the figures, as well as supporting a moveable angle guide 816. The edge guide is adjustable to enable an edge guide surface 818 to be fixed relative to a tangent (planar) extent of the belt 804 between rollers 806 and 808 to effect a sharpening operation on a cutting tool.

Figure 25C:
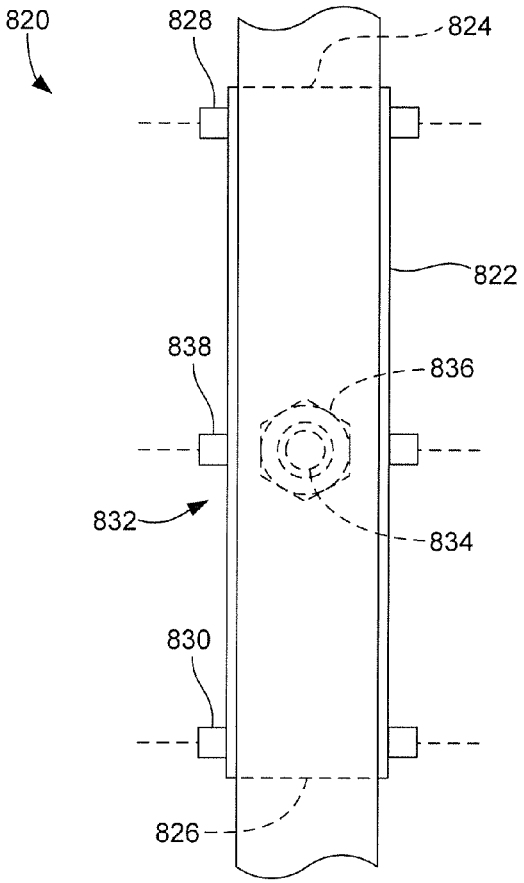

A platen assembly 820 is mounted to the frame 814. The platen assembly 820 comprises an elongated flexible plate 822 configured to extend along and support the back side of the belt 804 along the planar extent adjacent the angle guide 816. The plate 822 includes opposing ends 824, 826 that are affixed to the frame 814. The attachment of the opposing ends 824, 826 may be about respective shafts 828, 830, as generally represented in FIG. 25C, to allow relative movement of the ends of the plate with respect to the frame.

An adjustment mechanism 832 is secured between a medial portion of the plate 822 and the frame 814. The adjustment mechanism 832 includes a threaded shaft 834 and a user rotatable nut 836. A distal end of the shaft 834 is attached to a medial portion of the plate 822 via a coupling 838. User rotation of the nut 836 advances or retracts the distal end of the shaft 834, which in turn adjusts the profile of the plate 822 along the belt 804 by increasing or decreasing the length of the shaft. A substantially flat configuration for the plate is shown in FIG. 25A, and a convex (advanced) configuration for the plate is shown in FIG. 25B. Retraction of the shaft from the flat position in FIG. 25A can provide the plate 822 with a concave profile.

Figure 26A:
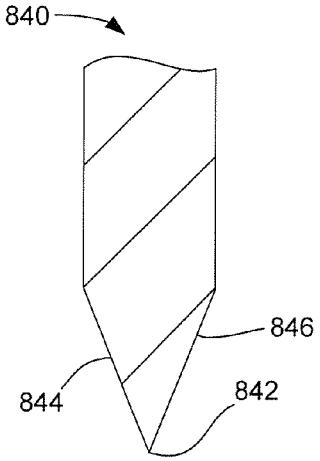
FIGS. 26A through 26C show different cutting tool geometries that can be obtained using the various embodiments of the present disclosure.
Figure 26B:
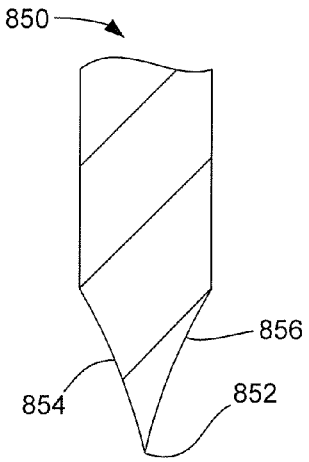
Figure 26C:
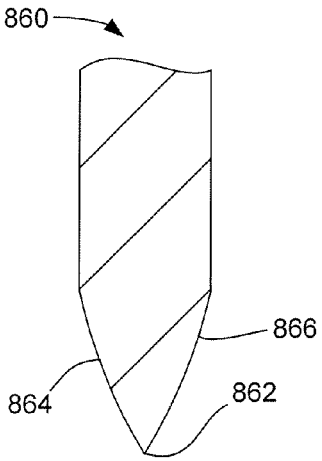

FIGS. 26A through 26C show different sharpening geometries that can be achieved using the various embodiments discussed above. FIG. 26A shows a blade 840 with cutting edge 842 and flat bevel surfaces 844, 846. The flat bevel surfaces can be obtained including through the use of a flat platen surface, as provided above including in FIGS. 22A-22B, 24A-24B and 25A. The flat surface may also be obtained if a flat surface is employed along the abrasive rod 306 of FIG. 17A.

FIG. 26B provides a blade 850 with a hollow grind geometry. Cutting edge 852 is formed along the intersection of concave bevel surfaces 854, 856. The hollow grind geometry can be obtained including through the use of the convex platen surfaces of FIGS. 22C, 24C and 25B.

FIG. 26C provides a blade 860 with a convex grind geometry. Cutting edge 862 is formed along the intersection of convex bevel surfaces 864, 866. The geometry can be obtained through the use of the belt sharpening mechanisms discussed herein, as well as by forming an adjustable platen to have a concave geometry. It will be appreciated that compound geometries can be achieved through combining the use of the various sharpening mechanisms discussed herein, and that recessed channels can further be formed in these and other geometries as desired.

Figure 27A:
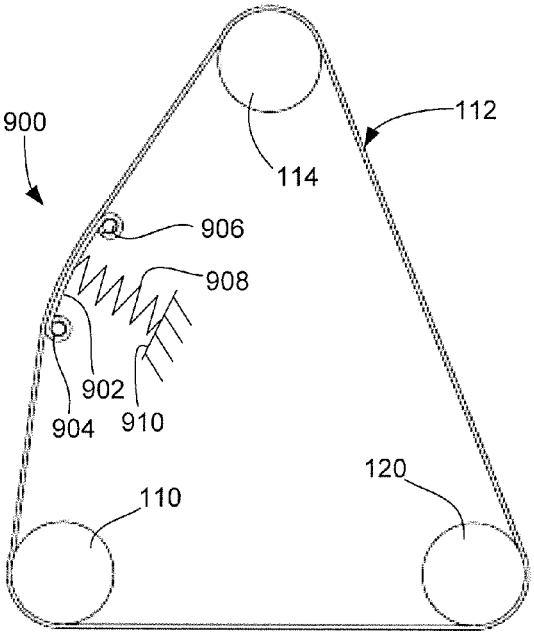
FIGS. 27A and 27B show a spring biased platen constructed in accordance with further embodiments.
Figure 27B:
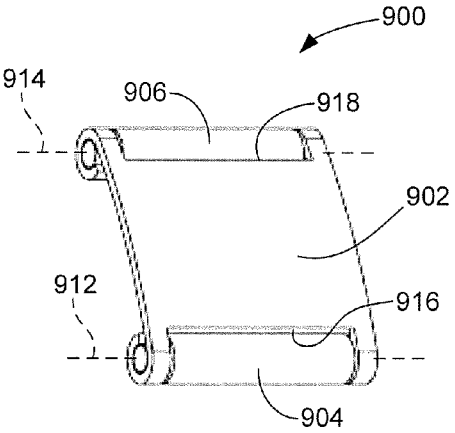

FIGS. 27A and 27B show yet another sharpening configuration that can be implemented in the various powered sharpeners discussed above. The configuration includes the previously described abrasive belt 112 routed along a belt path that contactingly passes about spaced apart rollers 110, 114 and 120 as generally set forth in FIG. 10A.

A platen assembly 900 can be utilized on one or both sides of the belt path. The platen assembly 900 provides biased support to the back side of the belt 112 during a sharpening operation and includes a curvilinearly extending platen or plate 902 bounded by rollers 904, 906. A biasing mechanism 908 such as in the form of a coiled spring exerts a biasing force between the plate 902 and a stationary support 910. In this way, the plate 902 is urged forward in the manner shown. Other configurations may provide a stationary plate or a fixed position plate as discussed above such as in FIGS. 25A and 25B.

As best shown in FIG. 27B, the rollers 904, 906 rotate about respective roller axes 912, 914. Apertures 916 and 918 are formed in the opposing ends of the plate 902 to expose medial portions of the rollers 904, 906 and allow the rollers to contactingly engage the belt 112.

Figure 28:
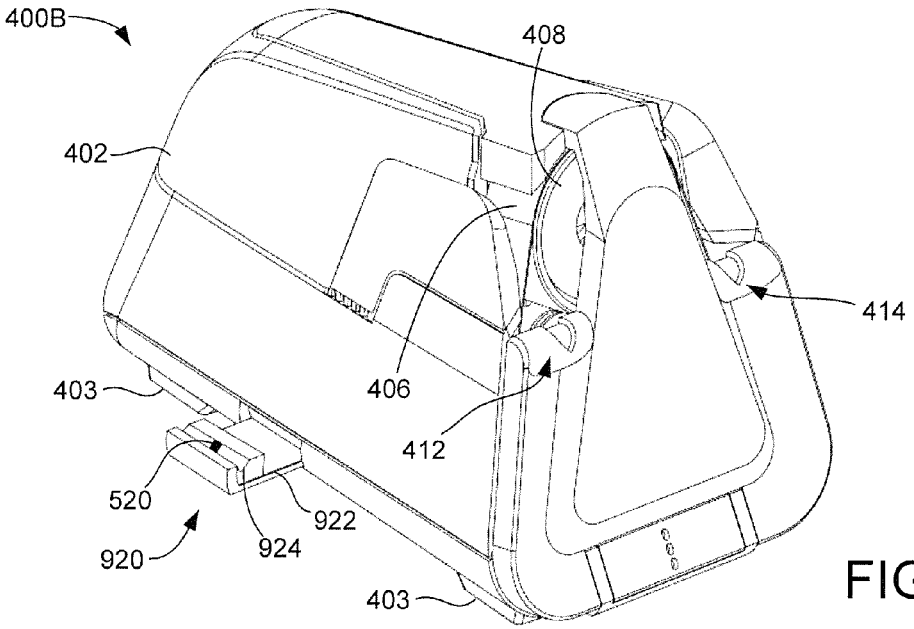
FIG. 28 shows another sharpener with the knurl roller of FIG. 18 in further embodiments.

FIG. 28 shows yet another tilt belt sharpener 400B similar to the sharpeners 400 and 400A discussed above, so like components have been given the same reference numerals for convenience. The sharpener 400B includes a cold forging assembly 920 in the form of an extendable and retractable tray 922 that can be deployed as desired to perform a cold forging operation upon a sharpened cutting edge.

The tray 922 includes a groove, or sharpening channel 924 to contactingly engage and orient a given cutting tool, and a cold forging member such as the knurl roller 520 discussed above in FIG. 18 is provided to form a plurality of spaced apart channels in the sharpened cutting edge by contactingly engaging the sharpened cutting edge with the cold forging member with sufficient force to displace portions of the sharpened cutting edge. As noted previously, this provides the channels as locally deformed, work hardened notches.

It will now be appreciated that the various embodiments presented herein can provide a number of benefits over the prior art. In embodiments that provide a non-orthogonal alignment angle, a differential deflection can be induced across the width of the belt with respect to the blade being sharpened. This provides a more uniform surface pressure and MTO rate against the side of the blade along the length thereof and tends to reduce increases of surface pressure at points along the cutting edge that experience relatively large amounts of variation of curvature, such as points adjacent the tip of the blade. As noted above, this non-orthogonal "tilt angle" belt sharpening can be carried out by enacting one or more of a tilt angle B (see e.g., FIGS. 4 and 7A-7B), a skew angle C (see e.g., FIGS. 8A-8B), and/or an offset/skewed support member (see e.g., FIGS. 9A-9B; 10A-10D; and 11A-11C).

In some embodiments, different belts having different abrasiveness levels and linear stiffness levels can be successively applied to the tool to provide a more complex sharpening process. For example and not by limitation, in one embodiment a first relatively stiffer, higher abrasive belt can be installed to provide a relatively coarse level of sharpening to the knife in which relatively more material is removed therefrom, followed by installation of a second, relatively less stiff belt with a more fine level of abrasive can be installed to provide a honing operation. The differences in stiffness can provide different levels of contour to the final blade geometry.

In further embodiments, sharpeners can be configured to employ a swarf airflow management system to remove swarf and enhance cooling of the sharpening operation; a secondary manual sharpening operation can be provided for honing, and this can include the generation of recessed notches to enhance cutting edge performance; and a biased platen assembly can be provided to further adjust various sharpening geometries.

It is to be understood that even though numerous characteristics and advantages of various embodiments of the present disclosure have been set forth in the foregoing description, together with details of the structure and function of various embodiments, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. A method for sharpening a metal cutting tool, comprising:

using a powered sharpener to sharpen a cutting edge of the cutting tool, the powered sharpener comprising an abrasive medium that is advanced by a motor and an edge guide surface adjacent the abrasive medium, wherein the cutting edge of the cutting tool is sharpened by bringing a first portion of the cutting edge into contacting engagement with the edge guide surface and drawing a second portion of the cutting edge across the abrasive medium; and forming a plurality of spaced apart channels that extend through the sharpened cutting edge by contactingly engaging the sharpened cutting edge with a cold forging member with sufficient force to displace portions of the sharpened cutting edge, the channels comprising locally deformed, work hardened notches.

2. The method of claim 1, wherein the abrasive medium comprises an endless abrasive belt that is advanced along a belt path comprising a first roller and a second roller, and the using step comprises contactingly engaging the abrasive belt along a planar extent of the abrasive belt between the first roller and the second roller.

3. The method of claim 1, wherein the cold forging member comprises a knurl roller having a central body rotatable about a central axis and a plurality of radially extending projections, wherein each projection is configured to form a different one of the channels along the cutting edge, and the forming step comprises placing a side of the cutting tool against a guide surface and moving the sharpened cutting edge along the knurl roller to rotate the knurl roller as the projections displace the portions of the sharpened cutting edge.

4. The method of claim 1, wherein the cold forging member is incorporated within a handle of a hand held manual sharpener, wherein an abrasive rod extends from the handle, and the method further comprises subsequently performing a secondary sharpening operation by advancing a selected side of the cutting tool along the abrasive rod to remove the displaced portions of material and expose at least one recessed cutting edge in each channel.

5. The method of claim 4, wherein the hand held manual sharpener further comprises a side guide surface having a line contact portion that extends at a selected angle with respect to a longitudinal central axis that passes through the handle and the abrasive rod, and wherein the secondary sharpening operation comprises contactingly aligning a side of the cutting tool against the side guide surface at the selected angle, and advancing the cutting edge along the abrasive rod while nominally maintaining the cutting tool at the selected angle.

6. The method of claim 5, wherein the selected angle is a first selected angle, the cold forging member is configured to rotate about a roller axis, the roller axis is configured to nominally extend at a second selected angle with respect to the longitudinal central axis, and the second selected angle is greater than the first selected angle.

7. The method of claim 1, further comprising a subsequent step of performing a secondary sharpening operation upon the cutting edge by bringing the first portion of the cutting edge into contacting engagement with the edge guide surface and drawing the second portion of the cutting edge across the abrasive medium to remove the displaced portions of the material from the cutting edge and expose at least one recessed cutting edge in each channel.

8. The method of claim 1, further comprising a subsequent step of performing a secondary sharpening operation upon the cutting edge by bringing the first portion of the cutting edge into contacting engagement with a second edge guide surface and drawing the second portion of the cutting edge across a second abrasive medium to remove the displaced portions of the material from the cutting edge and expose at least one recessed cutting edge in each channel, the second abrasive medium advanced relative to the cutting edge by a motor.

9. The method of claim 1, wherein the forming step comprises:

inserting the cutting edge of the cutting tool into a slot of a rigid body of a tool sharpener;

retracting the cutting edge across cold forging member disposed within an internal cavity of the rigid body to facilitate a cold forging operation upon the cutting edge to form the plurality of spaced apart channels along a length of the cutting edge; and subsequently advancing the cutting edge of the cutting tool along an abrasive member affixed to the rigid body to facilitate a secondary sharpening operation upon the cutting edge to provide each notch with at least one recessed cutting edge.

10. The method of claim 1, wherein the abrasive medium is characterized as an abrasive belt, and wherein the powered sharpener is characterized as a tilt belt sharpener comprising:

first and second rollers, the first roller rotatable about a first roller axis, the second roller rotatable about a second roller axis parallel to the first roller axis, wherein the abrasive belt is arranged along a belt path that passes over the first and second rollers to define a planar segment that lies along a neutral plane from the first roller to the second roller; and a guide assembly adjacent the planar segment of the belt comprising the edge guide surface to contactingly engage the cutting edge of the cutting tool and apply a non-uniform surface pressure to a side of the cutting tool adjacent the cutting edge across a width of the belt so that a greater amount of surface pressure is applied by a portion of the belt adjacent a proximal end of the blade portion adjacent the user handle of the cutting tool and a lesser amount of surface pressure is applied by a portion of the belt adjacent a distal end of the blade portion opposite the user handle.

11. The method of claim 10, wherein the guide assembly provides the greater amount of surface pressure by the portion of the belt adjacent the proximal end of the blade portion adjacent the user handle of the cutting tool and the lesser amount of surface pressure by the portion of the belt adjacent the distal end of the blade portion opposite the user handle by having a first edge guide surface adjacent a front edge of the belt configured to contactingly support a first portion of the cutting edge and a second edge guide surface adjacent an opposing rear edge of the belt configured to concurrently contactingly support a second portion of the cutting edge, wherein each of the first and second edge guide surfaces are the same selected distance from a horizontal plane, and wherein the first roller axis and the second roller axis are non-parallel to the horizontal plane.

12. The method of claim 10, wherein the guide assembly provides the greater amount of surface pressure by the portion of the belt adjacent the proximal end of the blade portion adjacent the user handle of the cutting tool and the lesser amount of surface pressure by the portion of the belt adjacent the distal end of the blade portion opposite the user handle by having a side guide surface configured to support a side of the blade portion of the cutting tool along a plane that is outwardly skewed with respect to the neutral plane so that the distal end of the blade portion is farther away from the first roller axis than the proximal end of the blade portion.

13. The method of claim 10, wherein the guide assembly provides the greater amount of surface pressure by the portion of the belt adjacent the proximal end of the blade portion adjacent the user handle of the cutting tool and the lesser amount of surface pressure by the portion of the belt adjacent the distal end of the blade portion opposite the user handle by a support member which contactingly engages a backing layer of the abrasive belt opposite the abrasive surface below the cutting tool between the first and second rollers.

14. The method of claim 13, wherein the abrasive belt has an outer abrasive surface and an inner backing layer, and the support member comprises a platen member having a platen surface that contactingly engages the inner backing layer opposite a location at which the cutting edge contactingly engages the abrasive surface.

15. The method of claim 1, wherein the using step comprises sharpening at least a first side of a blade portion of the cutting tool to extend along a first plane to define the sharpened cutting edge as an intersection of the first side of the blade portion with an opposing second side of the blade portion, wherein each of the plurality of spaced apart channels comprises a base surface and opposing, generally triangular shaped recessed side surfaces, and wherein the base surface extends along a second plane that is skewed with respect to the first plane.

16. A sharpening system, comprising:

a powered sharpener configured to sharpen a cutting edge of a metal cutting tool, the powered sharpener comprising an abrasive medium configured to be advanced by a motor and an edge guide surface adjacent the abrasive medium configured to contactingly support a first portion of the cutting edge as a second portion of the cutting edge is drawn across the abrasive medium; and a cold forging member configured to form a plurality of spaced apart channels in the sharpened cutting edge by contacting engagement of the cutting edge with the cold forging member using sufficient force to displace portions of the cutting edge and form the channels as locally deformed, work hardened notches.

17. The sharpening system of claim 16, further comprising a hand held manual sharpener comprising a user handle and an elongated abrasive rod extending from a first end of the user handle, wherein the cold forging member is characterized as a rotatable knurl roller mounted for rotation within the user handle.

18. The sharpening system of claim 17, wherein the hand held manual sharpener further comprises a guide surface having a line contact portion that extends at a selected angle with respect to a longitudinal central axis that passes through the handle and the abrasive rod, the line contact portion configured to contactingly engage a side of the cutting tool to orient the cutting tool at the selected angle during a secondary sharpening operation in which the cutting edge is advanced along the abrasive rod while nominally maintaining the cutting tool at the selected angle as established by the guide surface.

19. The sharpening system of claim 18, wherein the selected angle is a first selected angle, the cold forging member is configured to rotate about a roller axis, the roller axis is configured to nominally extend at a second selected angle with respect to the longitudinal central axis, and the second selected angle is greater than the first selected angle.

20. The sharpening system of claim 16, wherein the abrasive medium comprises an endless abrasive belt configured to be advanced along a belt path comprising a first roller and a second roller, the edge guide surface disposed adjacent a planar extent of the abrasive belt between the first roller and the second roller.

21. The sharpening system of claim 16, wherein the cold forging member comprises a rotatable knurl roller having a central body rotatable about a central axis and a plurality of radially extending projections, wherein each projection is configured to form a different one of the channels along the cutting edge.

22. The sharpening system of claim 16, wherein the cold forging member is incorporated within a housing portion of the powered sharpener.

23. The sharpening system of claim 16, wherein the abrasive medium is characterized as an abrasive belt, and wherein the powered sharpener is characterized as a tilt belt sharpener comprising:

first and second rollers, the first roller rotatable about a first roller axis, the second roller rotatable about a second roller axis parallel to the first roller axis, wherein the abrasive belt is arranged along a belt path that passes over the first and second rollers to define a planar segment that lies along a neutral plane from the first roller to the second roller; and a guide assembly adjacent the planar segment of the belt comprising the edge guide surface to contactingly engage the cutting edge of the cutting tool and apply a non-uniform surface pressure to a side of the cutting tool adjacent the cutting edge across a width of the belt so that a greater amount of surface pressure is applied by a portion of the belt adjacent a proximal end of the blade portion adjacent the user handle of the cutting tool and a lesser amount of surface pressure is applied by a portion of the belt adjacent a distal end of the blade portion opposite the user handle.

24. The sharpening system of claim 16, wherein the cold forging member is mechanically coupled to a housing of the powered sharpener.

* * * * *